US008933682B2

(12) United States Patent
Shiina

(10) Patent No.: US 8,933,682 B2
(45) Date of Patent: Jan. 13, 2015

(54) BANDGAP VOLTAGE REFERENCE CIRCUIT

(75) Inventor: Yoshiomi Shiina, Yokohama (JP)

(73) Assignee: Spansion LLC, Sunnyvale, CA (US)

( * ) Notice: Subject to any disclaimer, the term of this patent is extended or adjusted under 35 U.S.C. 154(b) by 401 days.

(21) Appl. No.: 12/853,425

(22) Filed: Aug. 10, 2010

(65) Prior Publication Data

US 2011/0037451 A1 Feb. 17, 2011

(30) Foreign Application Priority Data

Aug. 14, 2009 (JP) ..... 2009-187999

(51) Int. Cl.
*G05F 3/16* (2006.01)
*G05F 3/30* (2006.01)

(52) U.S. Cl.
CPC ..... *G05F 3/30* (2013.01)
USPC ..... 323/313

(58) Field of Classification Search
CPC ..... G05F 3/30; G05F 3/262
USPC ..... 323/313, 314, 315, 316
See application file for complete search history.

(56) References Cited

U.S. PATENT DOCUMENTS

| | | | | |
|---|---|---|---|---|
| 4,317,054 | A * | 2/1982 | Caruso et al. | 327/539 |
| 4,769,588 | A * | 9/1988 | Panther | 323/280 |
| 5,051,707 | A * | 9/1991 | Fujita | 330/279 |
| 5,319,303 | A * | 6/1994 | Yamada | 323/313 |
| 5,545,977 | A | 8/1996 | Yamada et al. | |
| 5,686,823 | A * | 11/1997 | Rapp | 323/313 |
| 6,150,872 | A | 11/2000 | McNeill et al. | |
| 6,194,887 | B1 | 2/2001 | Tsukada | |
| 6,384,586 | B1 * | 5/2002 | Sugawara | 323/313 |
| 6,677,808 | B1 * | 1/2004 | Sean et al. | 327/539 |
| 6,922,045 | B2 * | 7/2005 | Self et al. | 323/313 |
| 7,098,729 | B2 | 8/2006 | Abe | |

(Continued)

FOREIGN PATENT DOCUMENTS

| | | |
|---|---|---|
| EP | 0651311 A2 | 5/1995 |
| JP | 61-58017 A | 3/1986 |

(Continued)

OTHER PUBLICATIONS

Usada Masayuki, Reference Voltage Circuit (English Translation), Nov. 17, 2005, p. 1-11.*

(Continued)

*Primary Examiner* — Gary L Laxton
*Assistant Examiner* — Alex Torres-Rivera
(74) *Attorney, Agent, or Firm* — Stearne, Kessler, Goldstein & Fox P.L.L.C.

(57) ABSTRACT

A bandgap voltage reference circuit comprising: a first P-N junction circuit generating a first voltage which changes according to a first characteristic; a second P-N junction circuit generating a second voltage which changes according to a second characteristic different from the first characteristic; an amplifier receiving the first and second voltages at a pair of input terminals and changing the amount of an output current provided from a high-voltage power supply to an output terminal according to a difference voltage between the first and second voltages, wherein an output voltage at the output terminal is provided to the first and second P-N junction circuits; and an output current controller causing the amplifier to provide the output current to the output terminal regardless of the difference voltage when the output voltage equals to or is smaller than a threshold voltage.

14 Claims, 19 Drawing Sheets

(56) References Cited

U.S. PATENT DOCUMENTS

| | | | | |
|---|---|---|---|---|
| 7,215,183 | B2 * | 5/2007 | Nakada | 327/539 |
| 7,443,241 | B2 * | 10/2008 | Fong et al. | 330/254 |
| 2005/0030099 | A1 * | 2/2005 | Ishida et al. | 330/279 |
| 2008/0074185 | A1 * | 3/2008 | Ishida | 330/129 |
| 2008/0218268 | A1 * | 9/2008 | Ishida | 330/281 |
| 2008/0258702 | A1 * | 10/2008 | Kanamaru et al. | 323/351 |
| 2009/0117868 | A1 * | 5/2009 | Exeter | 330/254 |
| 2010/0164466 | A1 * | 7/2010 | Jo | 323/313 |

FOREIGN PATENT DOCUMENTS

| | | | |
|---|---|---|---|
| JP | 6-76571 | A | 3/1994 |
| JP | 7-121255 | A | 5/1995 |
| JP | 2000-89844 | | 3/2000 |
| JP | 2000-148263 | A | 5/2000 |
| JP | 2004-086750 | A | 3/2004 |
| JP | 2004-341877 | A | 12/2004 |
| JP | 2005-322152 | A | 11/2005 |
| JP | 2005-339423 | A | 12/2005 |
| JP | 2006-23920 | A | 1/2006 |
| JP | 2009-037372 | A | 2/2009 |

OTHER PUBLICATIONS

English-Language Abstract for Japanese Patent Publication No. 2005-322152 A, published Nov. 17, 2005; 1 page.

English-Language Abstract for Japanese Patent Publication No. 2009-037372 A, published Feb. 19, 2009; 1 page.

English-language Abstract of Japanese Patent Application Publication No. 61-58017 A; 2 pages.

English-language Abstract of Japanese Patent Application Publication No. 2004-341877 A; 2 pages.

English-language Abstract of Japanese Patent Application Publication No. 2005-339423 A; 2 pages.

* cited by examiner voltage
Vout
t0
t1
Time t current
Ist
I1+I2+I(A1)
Time t voltage
Vout(Voff=0)
Vth
Vout(Voff≠0)
20
Time t voltage
Voff
STB2
VA
VB
VA'
VA
VB
VA'
STB1
Time t VA-VB
VA-VB
(VA-Voff)-VB
Time t
signal16 enable
disable
t0
t10
Time t

BANDGAP VOLTAGE REFERENCE CIRCUIT

CROSS REFERENCE TO RELATED APPLICATION

This application is based upon and claims the benefit of priority from the prior Japanese Patent Application NO. 2009-187999 filed on Aug. 14, 2009, the entire contents of which are incorporated herein by reference.

FIELD

The embodiments discussed herein are related to a bandgap voltage reference circuit.

BACKGROUND

A bandgap voltage reference circuit is a circuit generating a reference voltage that is less temperature-dependent on the basis of voltages of semiconductor P-N junctions. The reference voltage is widely used in analog circuits such as A-D converters, D-A converters, DC-DC converters, Low-Drop-out (LDO) regulators, and temperature sensors.

The bandgap voltage reference circuit includes P-N junction elements such as bipolar transistors, resistance elements, and a differential amplifier. The bandgap voltage reference circuit combines a P-N junction voltage which has a negative temperature characteristic in which the voltage decreases with increasing temperature and a thermal voltage which has a positive temperature characteristic in which the voltage increases with increasing temperature, thereby canceling out the temperature dependencies of the voltages to generate a reference voltage that is less temperature-dependent.

The bandgap voltage reference circuit typically has two stable operation points: one is a shutdown point at which output voltage is near 0 V (a first stable point) and a second stable point at which a desired voltage is output. Therefore, a startup circuit is provided to prevent the bandgap voltage reference circuit from stopping operation at the first stable point during power-up. The startup circuit forcibly supplies a startup current to the bandgap voltage reference circuit on startup of the bandgap voltage reference circuit to raises the output voltage of the output terminal to a voltage near the second stable point, rather than the first stable point.

A bandgap voltage reference circuit that has such a startup circuit is described in Japanese Laid-Open Patent Publication No. 2006-23920, for example.

Since the startup circuit described above supplies a startup current to the output terminal in order to forcibly raise the output voltage to a desired voltage on startup of the bandgap voltage reference circuit, current consumption is increased. Especially in the case of a circuit that is repeatedly powered on and off, startup current consumed by the startup circuit at each startup is not negligible. Such startup current consumption reduces the battery life of a battery-operated apparatus.

SUMMARY

According to a first aspect of the embodiments, a bandgap voltage reference circuit includes: a first P-N junction circuit generating a first voltage which changes according to a first characteristic; a second P-N junction circuit generating a second voltage which changes according to a second characteristic different from the first characteristic; an amplifier receiving the first and second voltages at a pair of input terminals and changing the amount of an output current provided from a high-voltage power supply to an output terminal according to a difference voltage between the first and second voltages, wherein an output voltage of the output terminal is provided to the first and second P-N junction circuits; and an output current controller causing the amplifier to provide the output current to the output terminal regardless of the difference voltage when the output voltage equals to or is smaller than a threshold voltage.

The object and advantages of the embodiments will be realized and attained by means of the elements and combinations particularly pointed out in the claims.

It is to be understood that both the foregoing general description and the following detailed description and are exemplary and explanatory and are not restrictive of the embodiments, as claimed.

DESCRIPTION OF EMBODIMENTS

Figure 1:
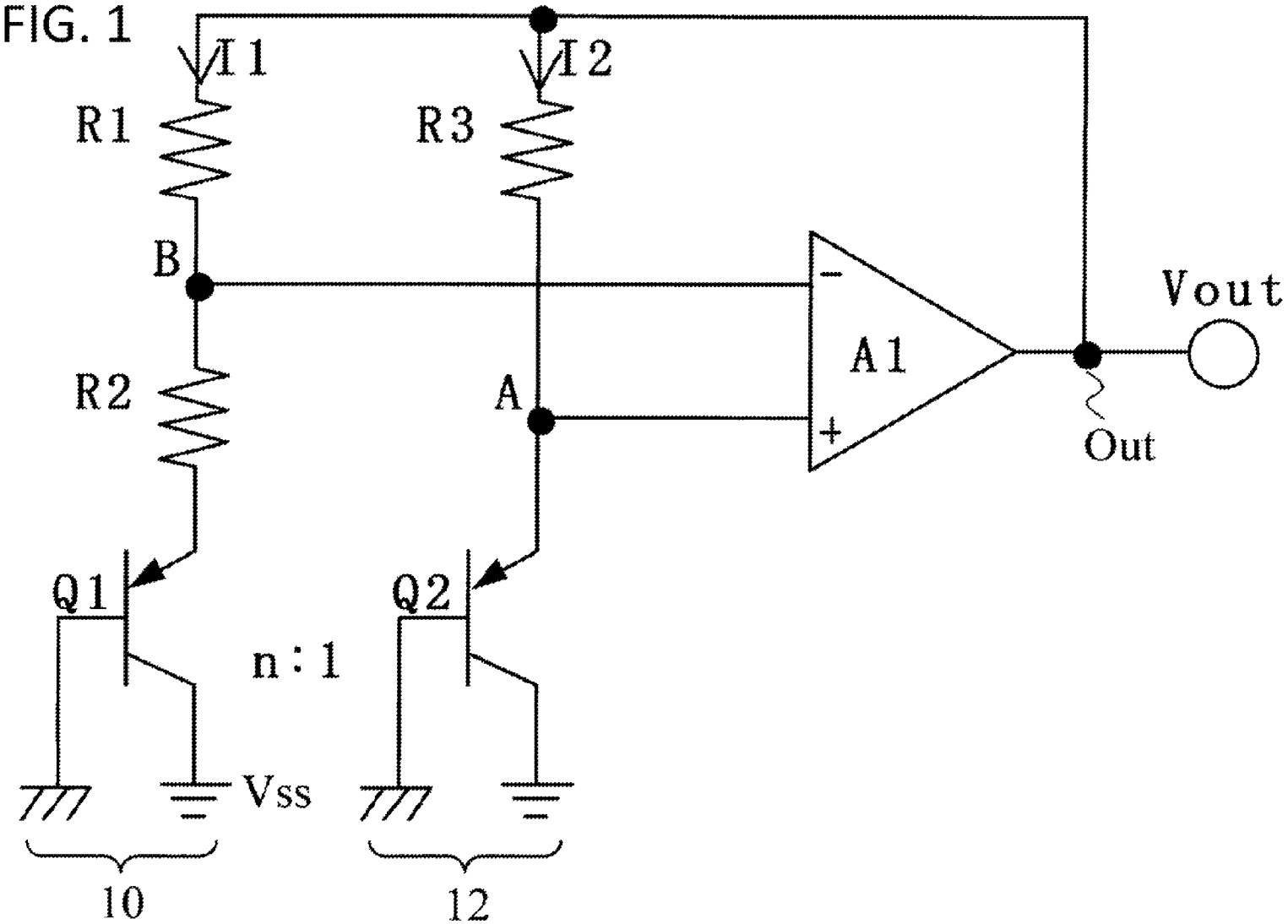
FIG. 1 is a diagram illustrating a configuration of a bandgap voltage reference circuit.

FIG. 1 is a diagram illustrating a configuration of a bandgap voltage reference circuit. The bandgap voltage reference circuit includes a first P-N junction circuit 10 which generates a voltage VB at node B, a second P-N junction circuit 12 which generates a voltage VA at node A, and an operational amplifier A1 which has a negative input terminal coupled to node B and a positive input terminal coupled to node A and changes the amount of an output current to be output to an output terminal Out according to the difference voltage between voltages VA and VB to output the changed output voltage Vout as a reference voltage.

The first P-N junction circuit 10 includes resistances R1 and R2 and a P-N junction element Q1 between the output terminal OUT and a low-voltage power supply (for example a ground) Vss and generates a voltage VB having a first characteristic at a coupling node B between the resistances R1 and R2. The second P-N junction circuit 12 has resistance R3 and a P-N junction element Q2 between the output terminal OUT and a low-voltage power supply Vss and generates a voltage VA having a second characteristic at a coupling node A between the resistance R3 and the P-N junction element Q2. The P-N junction area of the P-N junction element Q1 is greater than that of the P-N junction element Q2 by a factor of n (where n>1).

The P-N junction elements Q1 and Q2 in this example are PNP bipolar transistors in which the base and collector are shorted and the collector is coupled to the low-voltage power supply Vss. The base-emitter P-N junctions in the PNP bipolar transistors are used. That is, the emitter area ratio of the two transistors n:1 is used.

Here, let $V_{BE1}$ and $V_{BE2}$ denote the base-emitter voltages of the transistors Q1 and Q2, respectively, I1 and I2 denote the emitter currents of the transistors Q1 and Q2, respectively, and assume that the emitter currents I1 and I2 of the transistors Q1 and Q2 are equal to the corrector currents $I_{C1}$ and $I_{C2}$, respectively ($I1=I_{C1}$, $I2=I_{C2}$). Then the output voltage Vout of the bandgap voltage reference circuit in a stable state is $$\text{Vout}=V_{BE2}+R_3*I_{C2} \quad (1)$$

Since the voltages VA and VB at the pair of inputs of the operational amplifier A1 are equal in the stable state, the voltages at resistances R3 and R1 are equal: $R_3*I_{C2}=R_1*I_{C1}$. Therefore, the output voltage Vout is $$\text{Vout}=V_{BE2}+R_1*I_{C1} \quad (2)$$

When VA=VB, the emitter current density of the transistor Q1, which has a larger emitter size, is lower than that of the transistor Q2, therefore $V_{BE2}>V_{BE1}$. Since the voltage applied to resistance R2 is $V_{BE2}-V_{BE1}$, the current IC1 at resistance R2 is $(V_{BE2}-V_{BE1})/R2$. Therefore, Equation (2) is rewritten as $$\text{Vout}=V_{BE2}+(R_1/R_2)*(V_{BE2}-V_{BE1}) \quad (3)$$

Here, let $I_{C1}$ and $I_{C2}$ denote the corrector currents of the transistor Q1 and Q2, respectively, $I_{S1}$ and $I_{S2}$ denote the saturation currents of the transistors Q1 and Q2, respectively, k denote the Boltzmann constant, T denotes the absolute temperature, q denote electron charge, and $V_T$ denote thermal voltage VT=kT/q.

Then, $$I_{C1}=I_{S1}*\exp(V_{BE1}/V_T)$$

$$I_{C2}=I_{S2}*\exp(V_{BE2}/V_T)$$

The equations are rewritten as given below to obtain the base-emitter voltages $V_{BE1}$ and $V_{BE2}$ of the transistors Q1 and Q2:

$$V_{BE1}=Vhd\ T*\ln(I_{C1}/I_{S1})$$

$$V_{BE2}=V_T*\ln(I_{C2}/I_{S2})$$

where ln is logarithm natural.

Substituting $V_{BE1}$ and $V_{BE2}$ in Equation (3) yields the output voltage Vout as $$\text{Vout}=V_{BE2}+(R_1/R_2)*V_T*\ln(I_{S1}I_{C2}/I_{S2}I_{C1}) \quad (4)$$

Since $R_1I_{C1}=R_3I_{C2}$, Equation (4) is rewritten as $$\text{Vout}=V_{BE2}+(R_1/R_2)*V_T*\ln(I_{S1}R_1/I_{S2}R_3) \quad (5)$$

The first term of the right-hand side of Equation (5), the base-emitter voltage $V_{BE2}$, has a negative increase characteristic in response to a temperature rise whereas the second term of the right-hand side has a positive increase characteristic in response to a rise of absolute temperature T. The temperature characteristics of resistances R1 and R2 are canceled out by division. Thus, the temperature characteristics of the first and second terms of the right-hand side of Equation (5) cancel out and therefore the range of fluctuations of the output Vout in the steady state of the bandgap voltage reference circuit in response to temperature changes is reduced. That is, a reference voltage Vout with a small fluctuation range that depends on temperature may be obtained.

Figure 2:
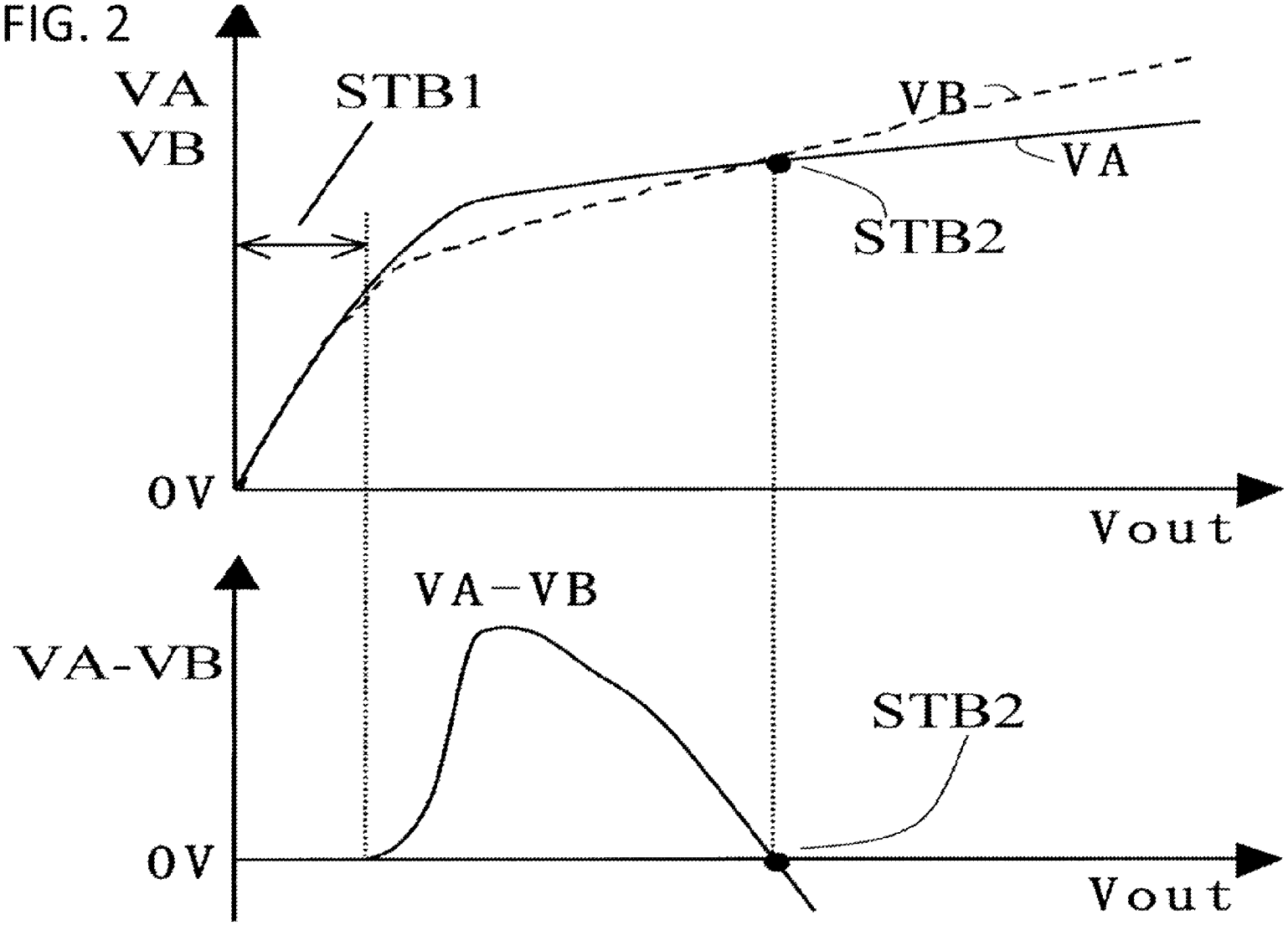
FIG. 2 illustrates plots of characteristics of the bandgap voltage reference circuit.

FIG. 2 illustrates plots of characteristics of the bandgap voltage reference circuit. The operational amplifier A1 of the bandgap voltage reference circuit provides an output current from a high-voltage power supply to its output terminal OUT according to the difference voltage between the voltages VA and VB of the pair of input terminals to generate the output voltage Vout. The output voltage Vout is applied to the first and second P-N junction circuits 10 and 12. However, the output voltage Vout gradually increases from 0 V during power-up.

As illustrated in FIG. 2, as the output voltage Vout gradually increases from 0 V, the voltages VA and VB increase accordingly, and a stable point STB1 at which VA=VB is reached. When the base-emitter voltages of the transistors Q1 and Q2 exceed their forward voltages VF, the transistors Q1 and Q2 start conducting currents I1 and I2. Since the emitter current density of the transistor Q1 is lower than that of the transistor Q2 due to the difference between the emitter sizes of the transistors Q1 and Q2, $V_{BE2}>V_{BE1}$. Therefore, the voltages VA and VB increase with VB<VA.

When the currents I1 and I2 flows, the voltages VB and VA become as follows.

$$VB=V_{BE1}+I_1R_2$$

$$\text{VA}=V_{BE2}$$

That is, as the output voltage Vout increases and the current I1 increases, the voltage VB increases to the level of the voltage VA and the operational amplifier A1 reaches the second stable point STB2 at which VB=VA. When the output voltage Vout and therefore current I1 further increases, the second stable point STB2 is passed and VB becomes greater than VA.

The vertical axis of the plot in the upper part of the FIG. 2 represents voltages VA and VB responsive to increase in the output voltage Vout, which is represented by the vertical axis. The plot in the lower part of the FIG. 2 illustrates the voltage VA−VB.

In this way, the output voltage Vout of the bandgap voltage reference circuit is controlled to a level around the second stable point STB2. The bandgap voltage reference circuit uses the operation of the operational amplifier A1 to output the output voltage Vout of Equation (5) at the second stable point STB2 as a reference voltage. Around the second stable point STB2, when VB becomes greater than VA, the operational amplifier A1 decreases the output current being provided to the output terminal OUT to reduce the output voltage Vout; when VB becomes smaller than VA, the operational amplifier A1 increases the output current being provided to the output terminal OUT to increase the output voltage Vout.

However, the operational amplifier A1 of the bandgap voltage reference circuit may not increase the output voltage Vout by itself during power-up. For example, since VB=VA=0 V during power-up, which is the first stable point STB1 state, the voltages at the input terminal pair of the operational amplifier A1 are equal and therefore the operational amplifier A1 may not increase the output voltage. This means that that the first stable point STB1 of the output voltage Vout is a shutdown point at which the bandgap voltage reference circuit shuts down.

Therefore, a startup circuit that forcibly increases the voltage at node A during power-up is usually provided in the bandgap voltage reference circuit in order to increase VB to a level higher than VA, thereby increasing the output voltage Vout to a level near the second stable point STB2.

Figure 3:
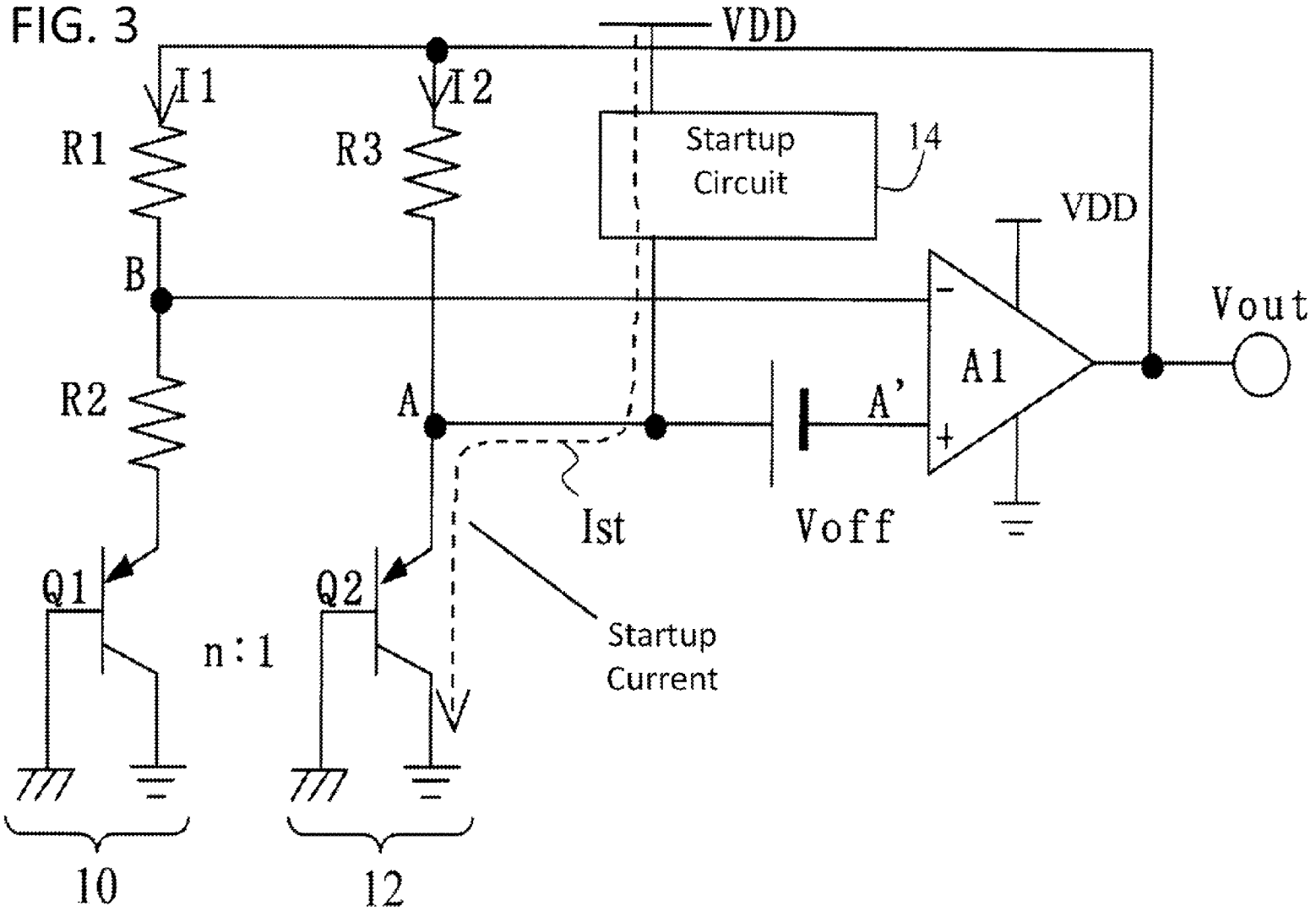
FIG. 3 is a diagram illustrating a bandgap voltage reference circuit having a startup circuit.

FIG. 3 illustrates a configuration of a bandgap voltage reference circuit having a startup circuit. The bandgap voltage reference circuit in FIG. 3 is similar to the one in FIG. 1 except that a startup circuit 14 is provided. During power-up, the startup circuit 14 provides a startup current Ist from a high-voltage power supply VDD to node A to forcibly raise the voltage VA at node A. As a result, VA becomes greater than VB and the operation of the operational amplifier A1 increases the output voltage Vout.

As depicted in FIG. 3, there is an offset voltage Voff at the positive input of the operational amplifier A1. The offset voltage Voff occurs in the operation amplifier A1 due to manufacturing variations of threshold values of transistors and other factors. The direction of the offset voltage is stably VB>VA or stably VB<VA. In the example in FIG. 3, the direction of the offset voltage is stably VB<VA. For example, when the relation between the voltages at nodes A and B becomes VB<VA, the voltage VB becomes equal to VA' (=VA−Voff) and the operational amplifier A1 is brought into balance.

Figure 4:
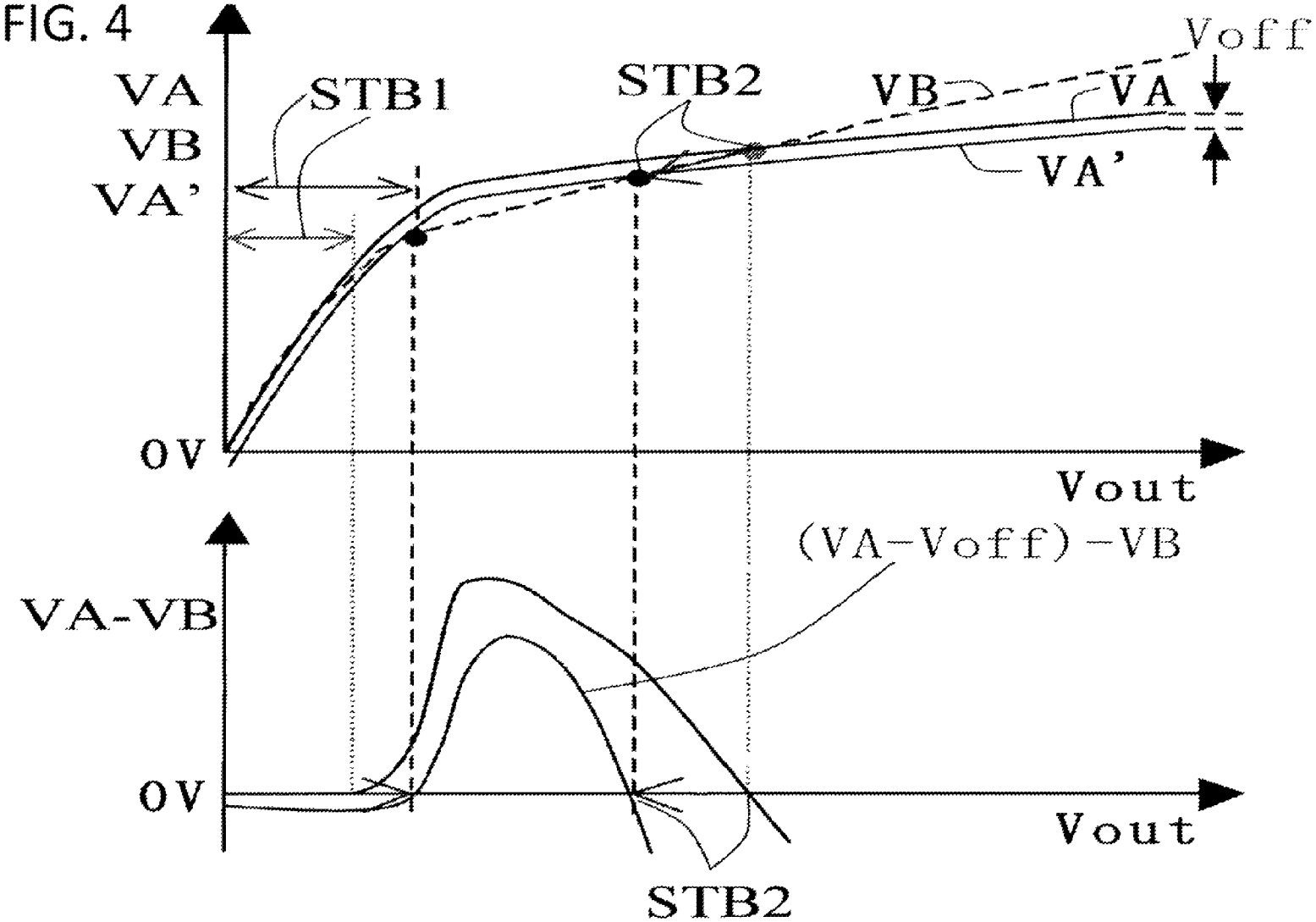
FIG. 4 illustrates plots of characteristics of the bandgap voltage reference circuit having an offset voltage.

FIG. 4 illustrates plots of characteristics of a bandgap voltage reference circuit having an offset voltage. If the direction of the offset voltage is stably VB<VA as in the example in FIG. 3, Equation (5) may be rewritten as $$\mathrm{Vout}=(V_{BE2}-V_{off})+(R_1/R_2)*VT*\ln(I_{S1}R_1/I_{S2}R_3) \quad (6).$$

As illustrated in FIG. 4, when there is an offset voltage Voff, the voltage VA' at the positive input terminal of the operational amplifier A1 appears to be lower than the voltage VA at node A by Voff. Therefore, the region of the first stable point STB1 extends to a higher output voltage and the region of the second stable point STB2 shifts toward a lower output voltage. Since VA=VB=0 V at Vout=0 V during power-up, the voltage VA' at the positive input terminal of the operational amplifier A1 is lower than the voltage VB of the negative input terminal (VB>VA') and the operational amplifier A1 operates to decrease the output current at the output terminal in an attempt to reduce the output voltage Vout. This makes the startup more difficult. Therefore, when there is an offset voltage, the amount of current provided by the startup circuit needs to be increased.

Figures 5A, 5B:
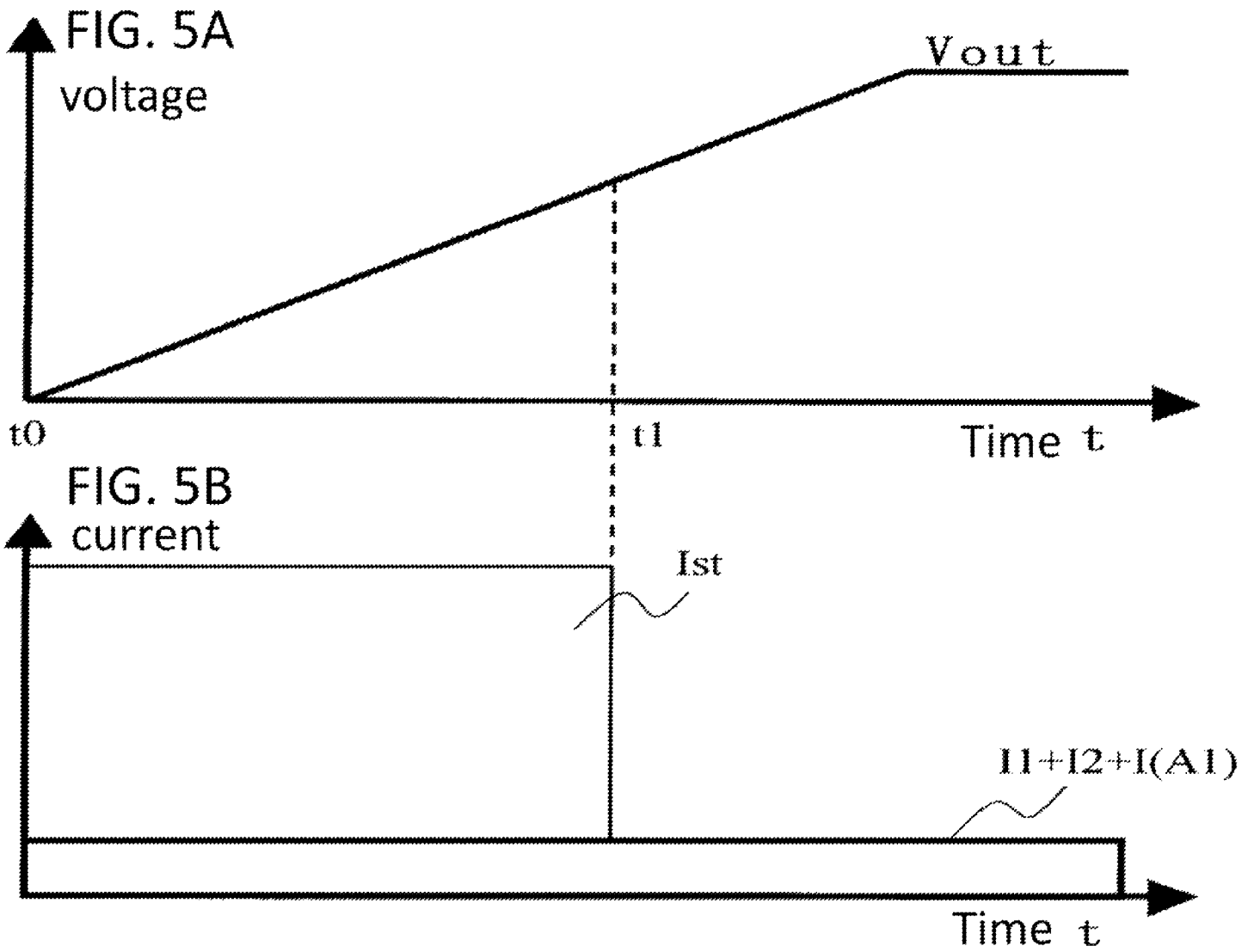
FIGS. 5A and 5B illustrate plots of current consumption in a bandgap voltage reference circuit having a startup circuit.

FIGS. 5A and 5B are graphs of current consumption in a bandgap voltage reference circuit having a startup circuit. FIG. 5A illustrates changes in output voltage Vout during power-up. The horizontal axis of the graph in FIG. 5A represents time and vertical axis represents voltage. FIG. 5B illustrates changes in current consumption during power-up. The horizontal axis of the graph in FIG. 5B represents time and the vertical axis represents current. During power-up, the startup circuit 14 provides a current Ist in the time period from time t0 to time t1 and therefore an amount of current consumed. The amount of current consumed during the period from time t0 to t1 is equal to the sum of the startup current Ist of the startup circuit 14 and the current I1+I2 consumed in the operation of the bandgap voltage reference circuit plus the current of the operational amplifier A1. In a system in which the bandgap voltage reference circuit is repeatedly started up, a larger amount of current may be consumed.

Figure 6:
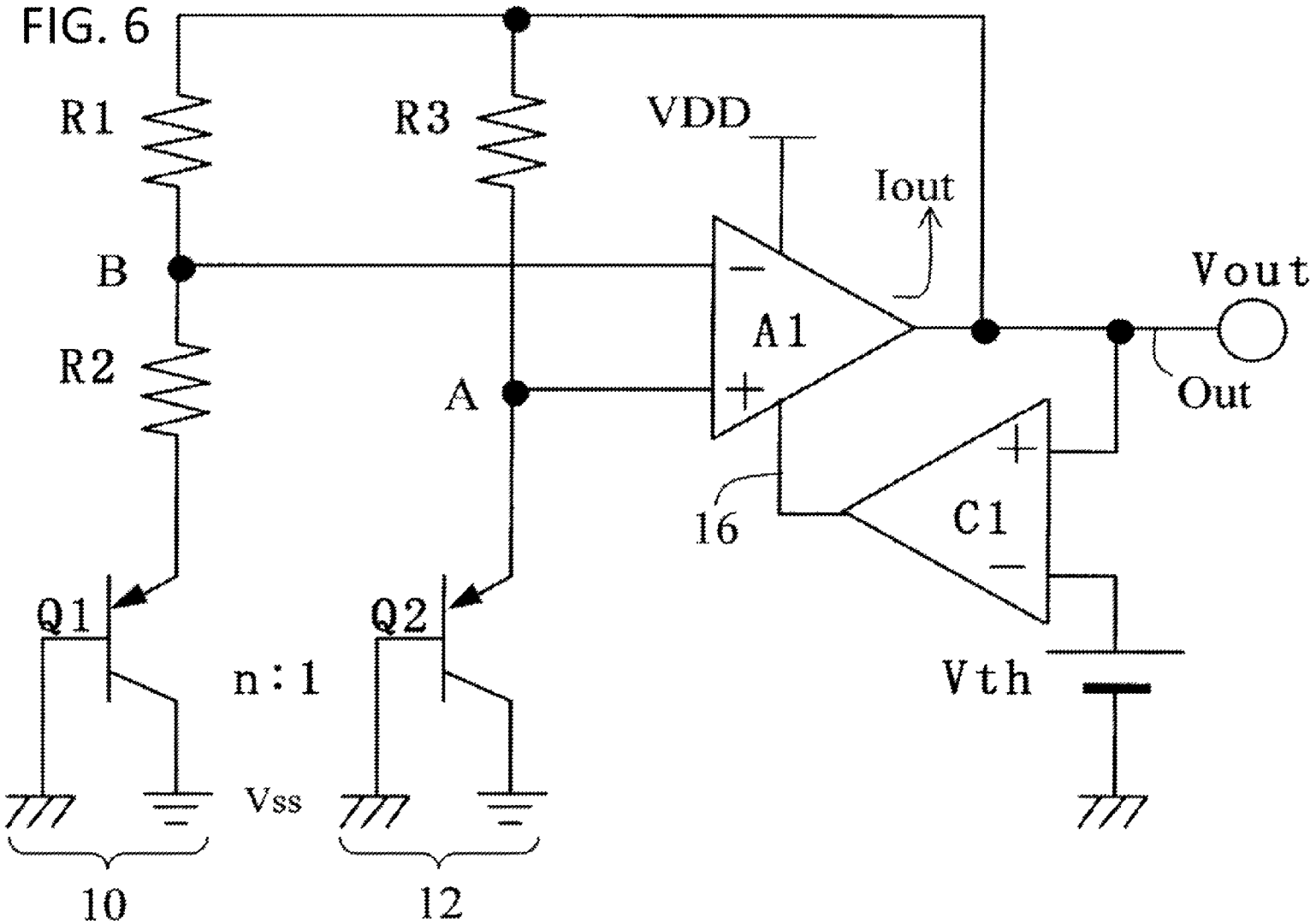
FIG. 6 is a diagram illustrating a configuration of a bandgap voltage reference circuit according to a first embodiment.

FIG. 6 illustrates a bandgap voltage reference circuit according to a first embodiment. The bandgap voltage reference circuit includes a first P-N junction circuit 10 which generates a voltage VB at node B, a second P-N junction circuit 12 which generates a voltage VA at node A, and an operational amplifier A1 which has a negative input terminal coupled to node B and a positive input terminal coupled to node A. The operational amplifier A1 changes the amount of an output current Iout being output to an output terminal Out according to the difference voltage between the voltages VA and VB to output an output voltage Vout as a reference voltage. The output current Iout is provided from a high-voltage power supply VDD.

The first P-N junction circuit 10 includes resistances R1 and R2 and a PNP transistor (P-N junction element) Q1 between an output terminal OUT and a ground Vss, which is a low-voltage power supply, and generates a voltage VB having a first characteristic at coupling node B between resistances R1 and R2. The second P-N junction circuit 12 includes resistance R3 and a PNP transistor (P-N junction element) Q2 between an output terminal OUT and the low-voltage power supply Vss and generates a voltage VA having a second characteristic at coupling node A between resistance R3 and the PNP transistor Q2. The emitter area of the PNP transistor Q1 is greater than that of the Q2 by a factor of n (where n>1). The circuit configuration described so far is the same as the circuit configuration in FIG. 1.

The bandgap voltage reference circuit further includes an output current controller C1 which provides a disabled control signal 16 to the operational amplifier A1 to cause the operational amplifier A1 to provide an output current Iout to the output terminal Out regardless of the difference voltage at the input terminals when the output voltage Vout equals to or is smaller than a threshold voltage Vth. In other words, the disabled control signal 16 disables the function of the output current decreasing function of the operational amplifier A1, which has the functions of increasing and decreasing the output current, so that a larger output current is output to the output terminal.

The operational amplifier A1 includes a differential circuit which generates a differential output signal according to the difference voltage between inputs and an output current supply circuit which changes the amount of output current Iout according to the differential output signal, as will be described later. The disabled control signal 16 disables the function of output current decreasing function of the output current supply circuit, for example, and enables the output current increasing function. As a result, the output voltage Vout increases by the function of the operational amplifier A1 during power-up.

When the output voltage Vout reaches the threshold voltage Vth, the output current controller C1 enables the control signal 16. The enabled control signal 16 causes the output current controller C1 to perform normal operation to increase or decrease the amount of the output current on the basis of the differential output signal.

Figures 7A, 7B, 7C, 7D:
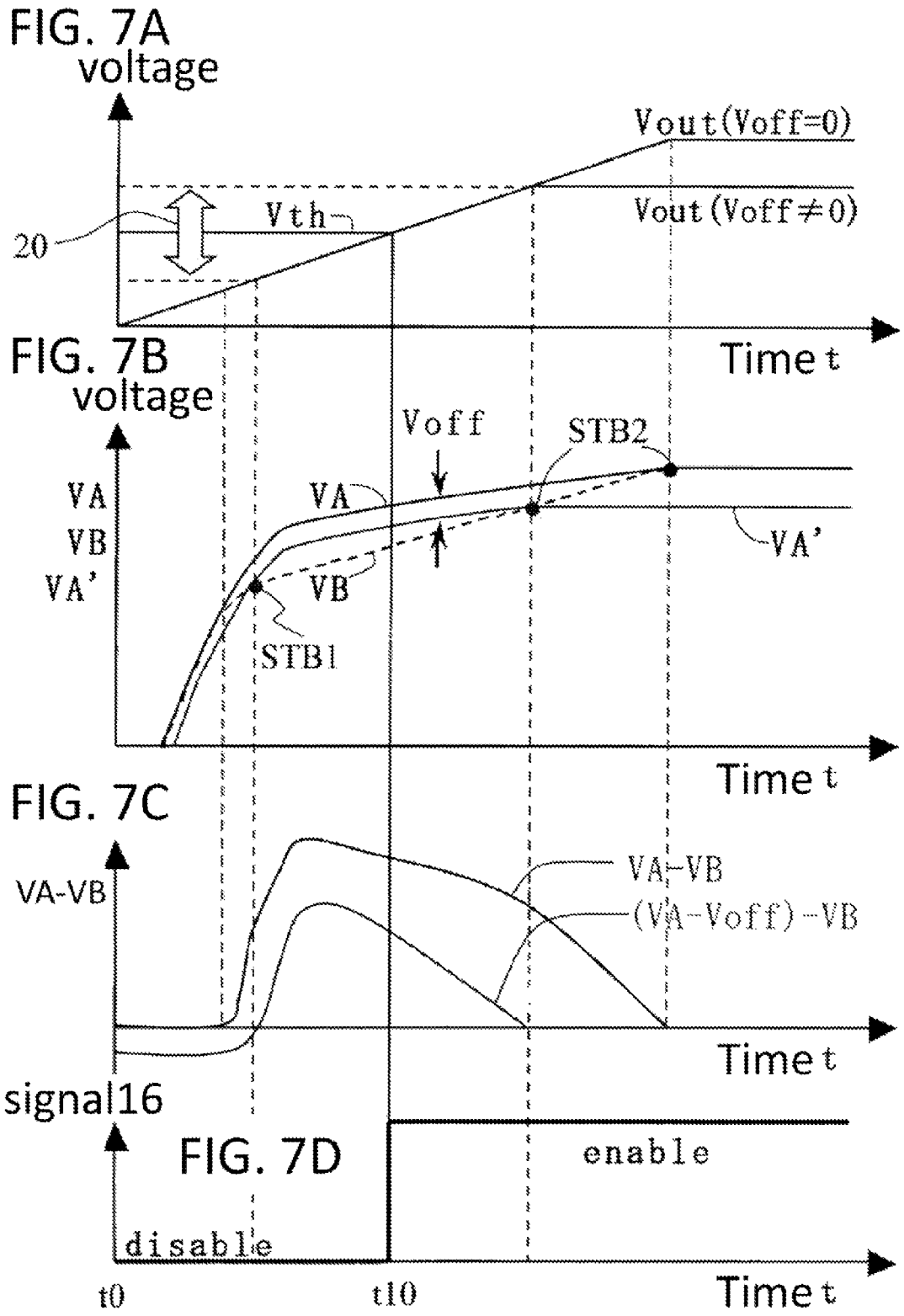
FIGS. 7A to 7D are diagrams illustrating an operation of the bandgap voltage reference circuit according to the first embodiment.

FIGS. 7A to 7D illustrate an operation of the bandgap voltage reference circuit according to the present embodiment. FIG. 7A, like FIG. 5A, illustrates changes in the output voltage Vout during power-up. FIGS. 7B and 7C are diagrams similar to FIG. 4. FIG. 7B, like the upper part of the FIG. 4, illustrates changes in voltages VA and VB and FIG. 7C illustrates changes in the difference voltage VA−VB between VA and VB. FIG. 7D illustrates changes of the control signal 16.

As illustrated in FIG. 7D, the control signal 16 is disabled at the beginning t0 of startup and is enabled at time t10 at which the output voltage Vout reaches a threshold voltage Vth. The threshold voltage Vth may be set to a value in a range 20 in FIG. 7A. The threshold voltage Vth needs to be higher than the highest first stable point STB1 voltage illustrated in FIG. 7B and does not need to be higher than the lowest second stable point STB2 voltage. The lowest second stable point STB2 voltage is determined by taking into consideration the range of fluctuations of the offset voltage Voff and is the voltage at the second stable point STB2 at which the largest fluctuation in the offset voltage Voff appears.

In this way, the output voltage Vout may be raised quickly and stably by the operational amplifier A1 continuing to forcibly increase the output current Iout during power-up regardless of the difference voltage between the inputs. When the output voltage Vout reaches the threshold voltage Vth, the input voltage VA has become greater than VB. Accordingly, the output voltage Vout may be further increased by the normal operation of the operational amplifier A1 and stabilized at the second stable point STB2 even when the control signal 16 is enabled. The same applies if there is an offset voltage Voff, because VA' has become greater than VB at the time when the output voltage Vout reaches the threshold voltage Vth.

Figure 8:
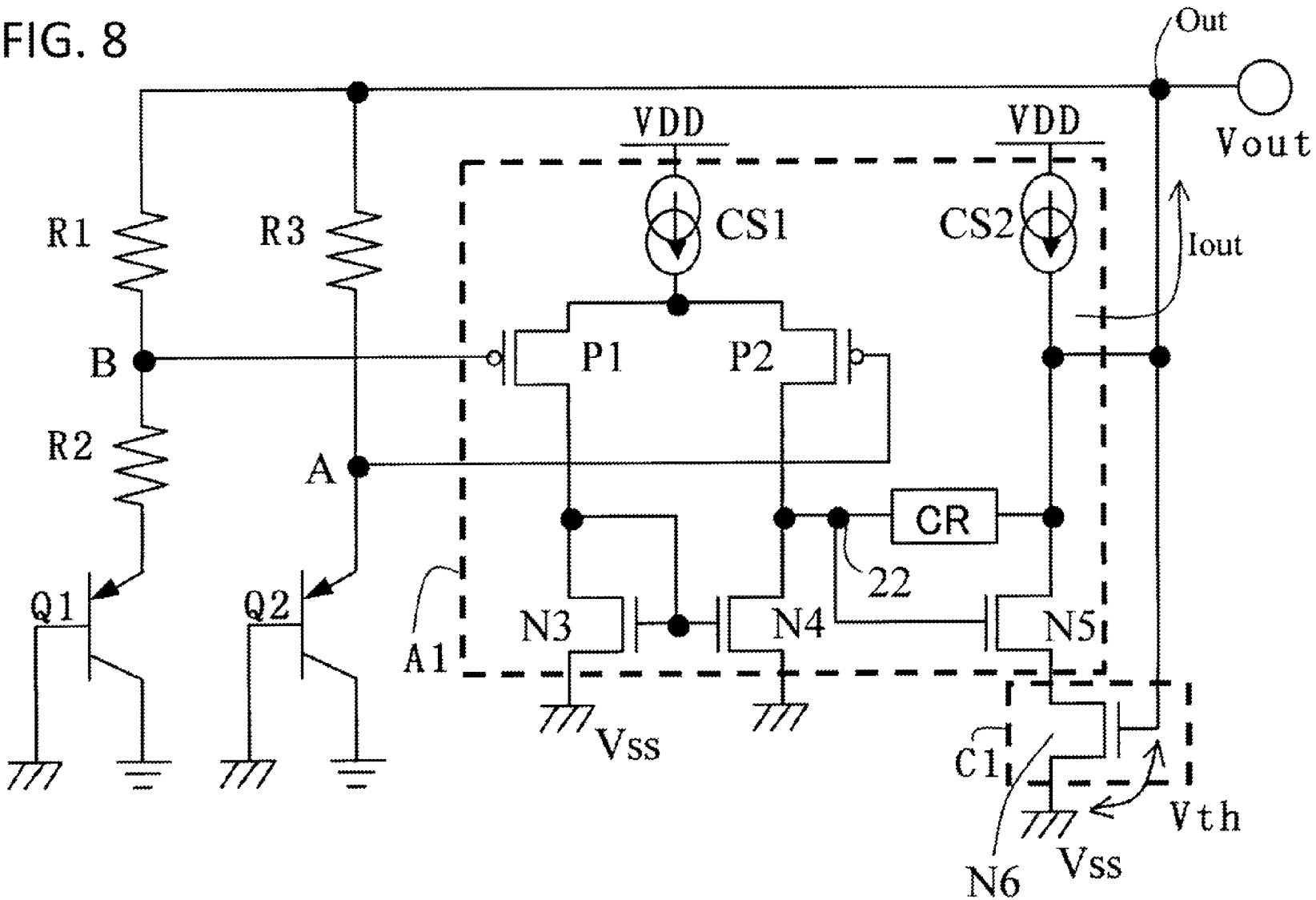
FIG. 8 is a circuit diagram of a first example of the bandgap voltage reference circuit according to the first embodiment.

FIG. 8 is a circuit diagram of a first example of the bandgap voltage reference circuit according to the first embodiment. The circuit diagram illustrates specific circuits of the operational amplifier A1 and the output current controller C1. The operational amplifier A1 includes a differential circuit including a current source CS1 coupled to a high-voltage power supply VDD, a P-channel MOS transistors P1 and P2 having sources coupled to the current source CS1 and gates coupled to nodes B and A, respectively, and N-channel MOS transistors N3 and N4 having sources coupled to a low-voltage power supply Vss. The operational amplifier A1 further includes an output current supply circuit including a current source CS2 coupled to the high-voltage power supply VDD and an N-channel MOS transistor N5 which receives a differential output signal 22 at its gate from the differential circuit. An anti-oscillation capacitor-resistor (CR) circuit CR is provided between the node of the differential output signal 22 and the output terminal Out. An N-channel transistor N6 having a gate coupled to the output terminal Out is provided as an output current controller C1 between the transistor N5 and a ground Vss.

The differential circuit formed by the transistors P1, P2, N3 and N4 and the current source CS1 generates a differential output signal 22 according to the difference between voltages at nodes A and B. The output current supply circuit, on the other hand, outputs a current from the current source CS2 to the output terminal Out as an output current Iout. The transistor N5 is a pull-down element. The transistor N5 changes its conduction according to the differential output signal 22 and absorbs a part of a current from the current source CS2 to the ground Vss. Increase or decrease of the absorbed current increases or decreases the output current Iout.

The transistor N6 which constitutes the output current controller C1 is in the off state until the output voltage Vout reaches the threshold voltage Vth of the transistor N6. Accordingly, the transistor N5, which is the pull-down element, is disabled and the operational amplifier A1 outputs all of the current from the current source CS2 as the output current Iout to raise the output voltage Vout regardless of the difference voltage between inputs. When the output voltage Vout reaches the threshold voltage Vth, the transistor N6 is turned on, the transistor N5 is enabled and the normal operation is started. In the normal operation, the operational amplifier A1 increases or decrease the output current Iout according to the difference voltage between the inputs and becomes stable at the second stable point described earlier.

Figure 9:
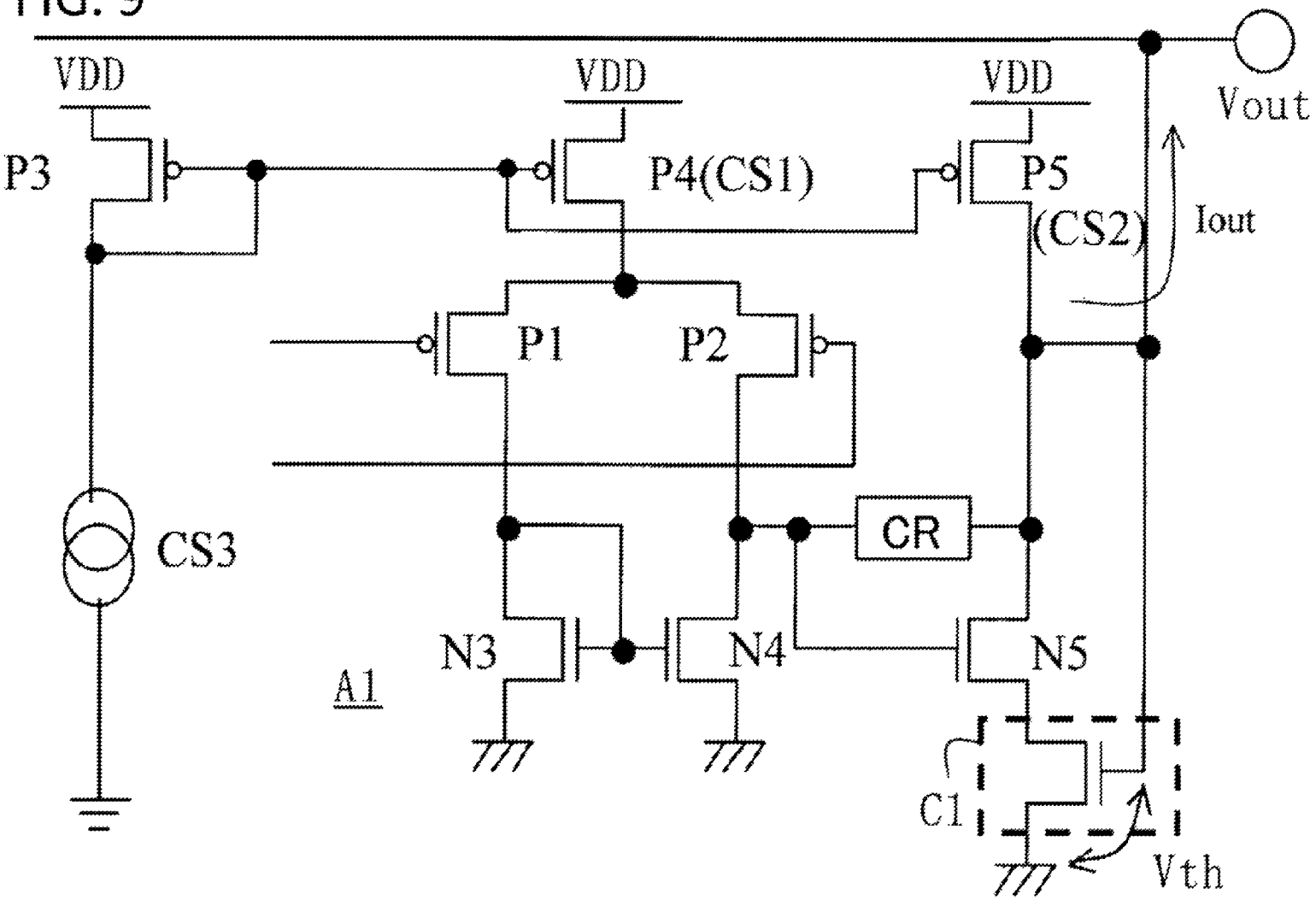
FIG. 9 is a circuit diagram illustrating exemplary current sources CS1 and CS2 in an operational amplifier A1 in FIG. 8.

FIG. 9 is a circuit diagram illustrating exemplary current sources CS1 and CS2 in the operational amplifier A1 in FIG. 8. P-channel transistors P3, P4 and P5 constitute a current mirror circuit. The transistor P3 is coupled to a current source CS3 and a current generated in the transistor P3 is also generated in the transistors P4 and P5. However, the amounts of current in the transistors P4 and P5 depend on the ratio of their sizes to the size of the transistor P3.

Figure 10:
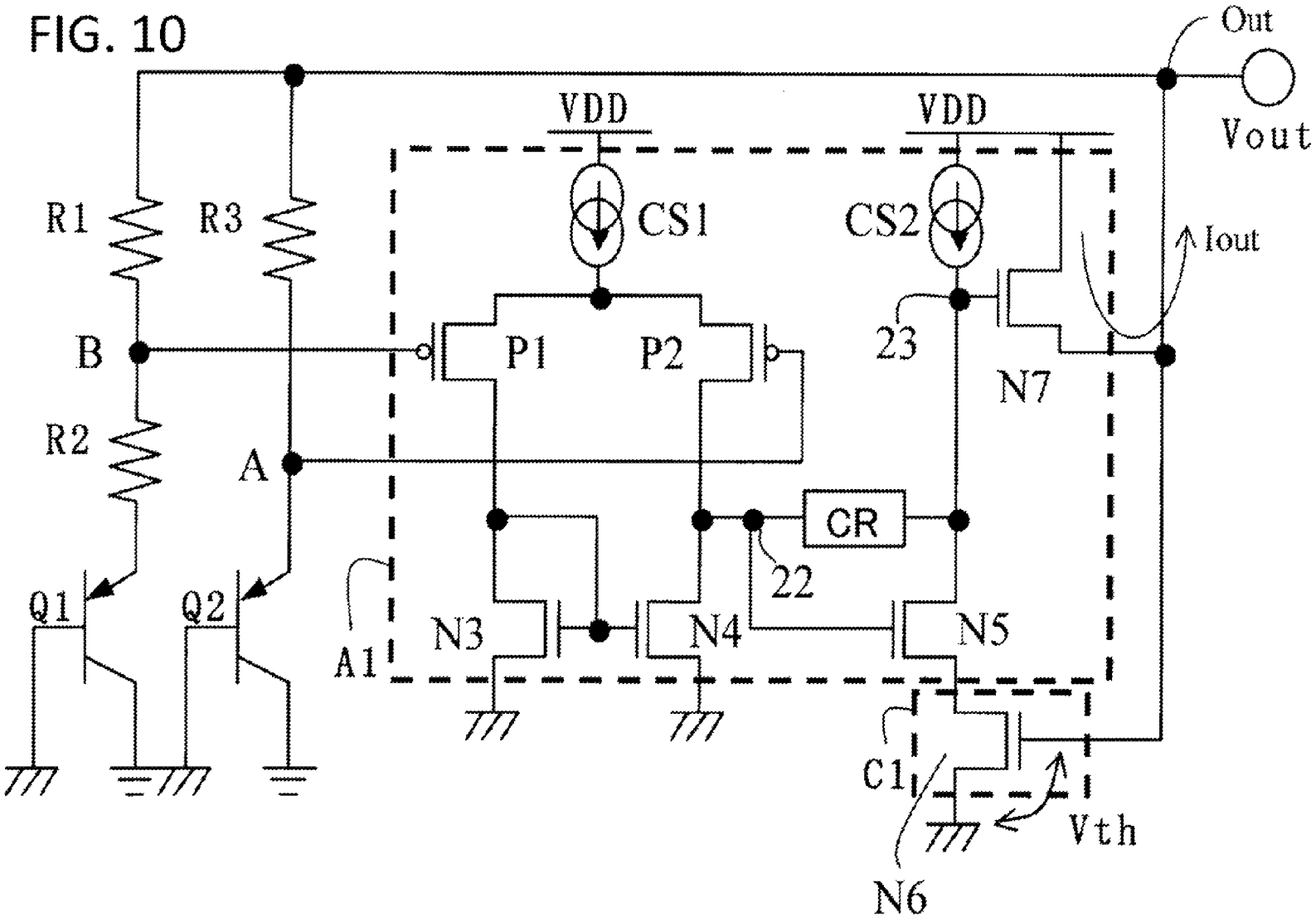
FIG. 10 is a circuit diagram of a second example of the bandgap voltage reference circuit according to the first embodiment.

FIG. 10 is a circuit diagram of a second example of the bandgap voltage reference circuit according to the first embodiment. In the second exemplary circuit, the operational amplifier A1 includes an output transistor N7 whose gate is coupled to a coupling node 23 between a current source CS2 and a transistor N5. The rest of the circuit is the same as the first exemplary circuit in FIG. 8. The output transistor N7 is an N-channel transistor provided between a high-voltage power supply VDD and an output terminal Out. A control signal that is the inverse of a signal of a node 22 is generated at the node 23, as has been described, to cause the transistor N7 to function as a source follower transistor. When the output voltage Vout is lower than a threshold voltage Vth, the transistor N6 which constitutes the output current controller C1 is turned off to increase the voltage at node 23, increases the driving capability of the output transistor N7, and increases the output current Iout. When the output voltage Vout becomes higher than or equal to the threshold voltage Vth, the transistor N6 is turned on to place the transistor N5 in a normal operation state.

This circuit is called series reference in which a current of the current source CS2 is set to a small value compared with the first exemplary circuit in FIG. 8, which is a shunt reference, and a given amount of output current Iout is provided from the output transistor N7. Therefore, current consumption in the entire circuit may be reduced.

Figure 11:
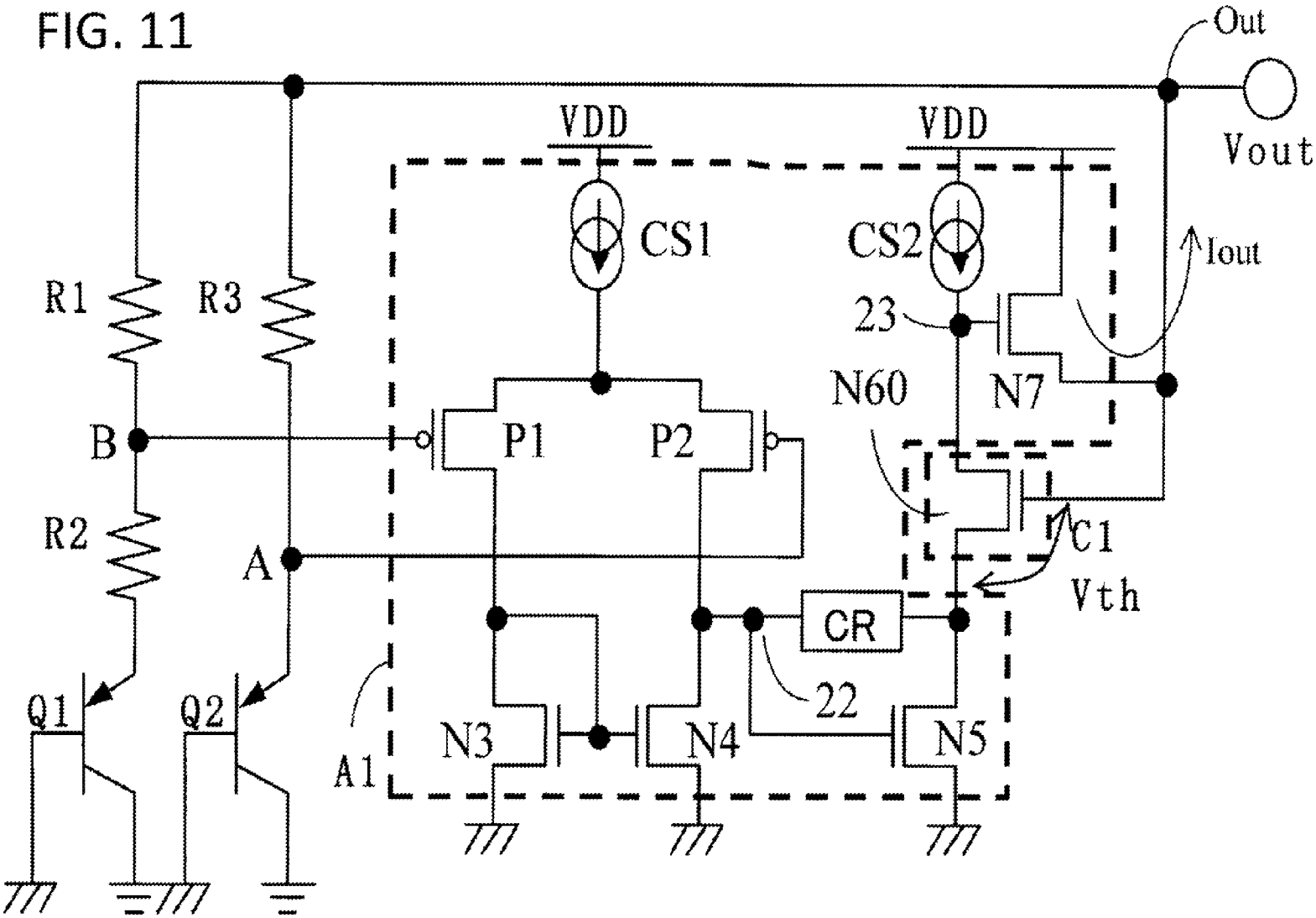
FIG. 11 is a circuit diagram of a third example of the bandgap voltage reference circuit according to the first embodiment.

FIG. 11 is a circuit diagram of a third example of the bandgap voltage reference circuit according to the first embodiment. In the third exemplary circuit, the operational amplifier A1 includes an output transistor N7 whose gate is coupled to a coupling node 23 between a current source CS2 and a transistor N5 and a transistor N60 constituting an output current control circuit C1 is provided between the gate of the output transistor N7 and the transistor N5. The rest of the circuit is the same as the second exemplary circuit in FIG. 10.

Operation of the third exemplary circuit is similar to the exemplary circuit in FIG. 10. When the output voltage Vout is lower than a threshold voltage Vth, the transistor N60 is turned off to increase the voltage at node 23, increase the driving capability of output transistor N7 and increase the output current Iout. When the output voltage Vout increases to a value higher than or equal to the threshold voltage Vth, the transistor N60 is turned on to place the transistor N5 in a normal operation state.

Figure 12:
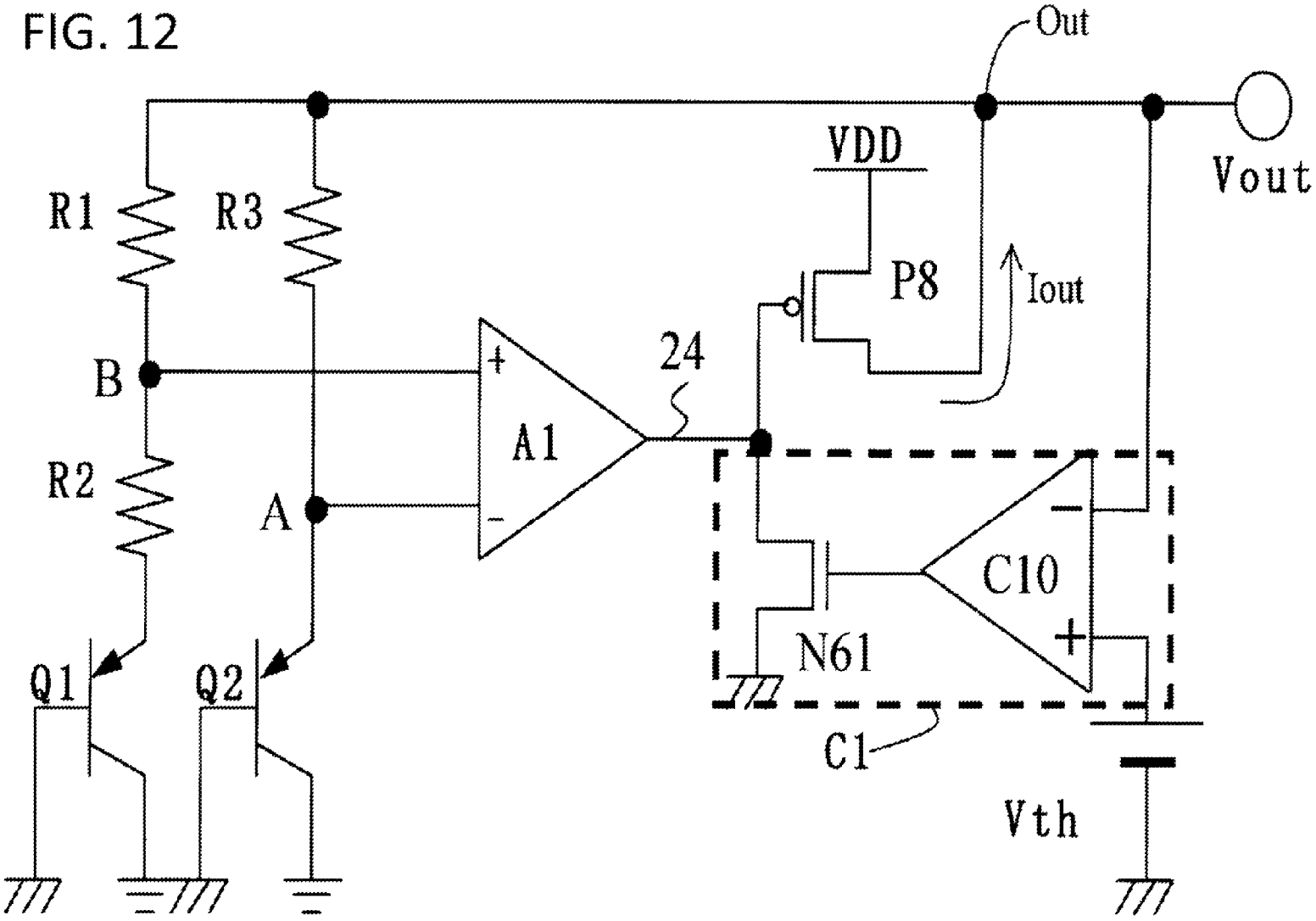
FIG. 12 is a circuit diagram of a fourth example of the bandgap voltage reference circuit according to the first embodiment.

FIG. 12 is circuit diagram of a fourth example of the bandgap voltage reference circuit according to the first embodiment. The fourth exemplary circuit includes a P-channel transistor P8 between a high-voltage power supply VDD and the output terminal Out as an output transistor, an N channel transistor N61 as an output current control circuit, and a comparator C10 which compares an output voltage Vout with a threshold voltage Vth. The internal configuration of the operational amplifier A1 is the same as that illustrated in FIG. 8. The N-channel output transistor N7 in FIGS. 10 and 11 is replaced with the P-channel output transistor P8.

Since the output transistor in the exemplary circuit is a P-channel transistor, node B is coupled to the positive input terminal of the operational amplifier A1 and node A is coupled to the negative input terminal. This coupling is the reverse of that in the examples in FIGS. 8, 10 and 11. When VA is greater than VB, a differential output signal 24 drops, which increases the degree of conduction of the output transistor P8 to increase the output current Iout; when VA equals to or is smaller than VB, the differential output signal 24 rises to reduce the degree of conduction of the output transistor P8 and decrease the output current Iout.

When the output voltage Vout is lower than the threshold voltage Vth, the comparator C10 outputs a high-level signal to force the transistor N61 into conduction. As a result, the output current Iout increases. When the output voltage Vout is higher than the threshold voltage Vth, the comparator C10 outputs a low-level signal to force the transistor N61 out of conduction to cause the output transistor P8 to be driven and controlled by the differential output signal 24.

Figure 13:
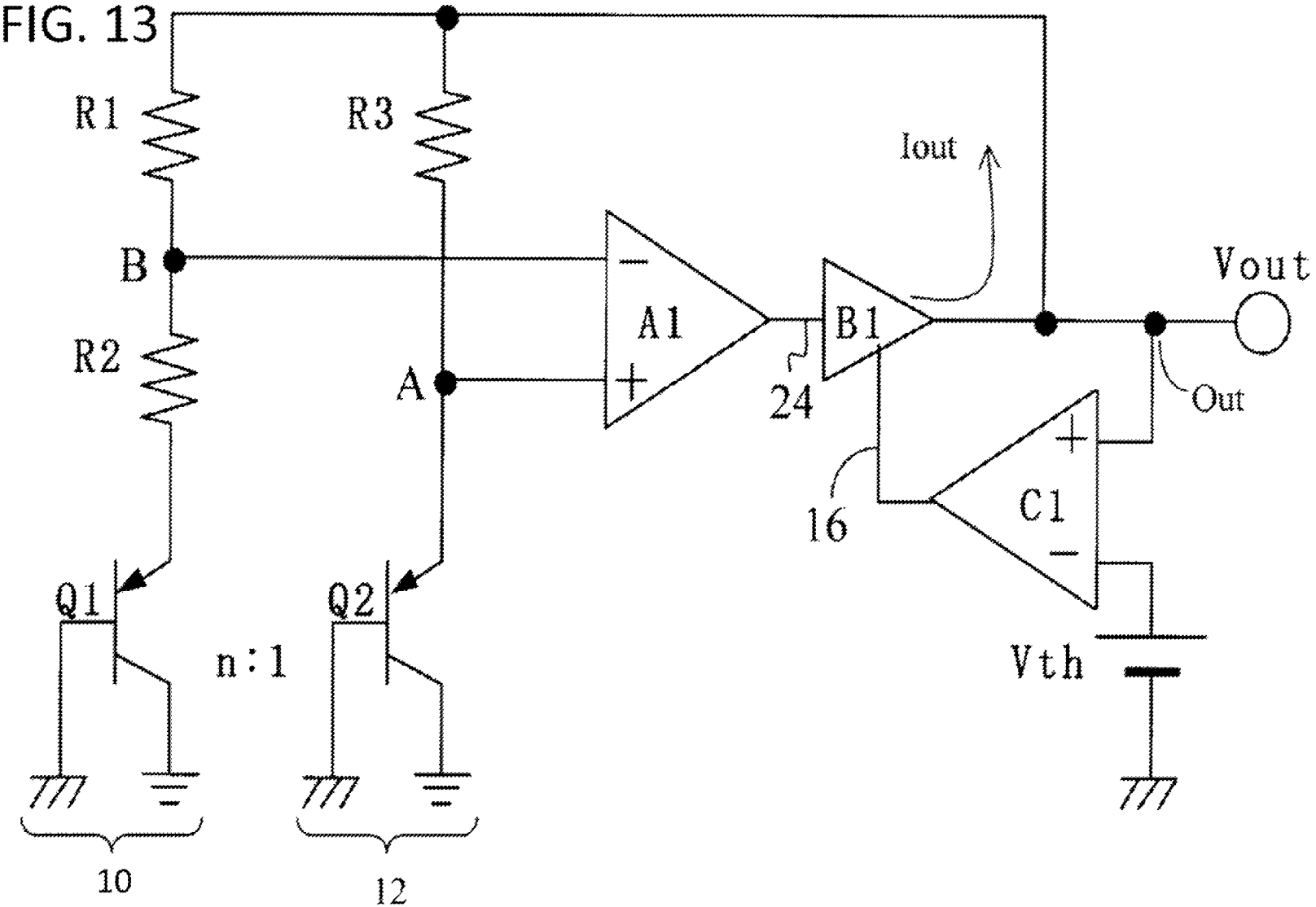
FIG. 13 is a diagram illustrating a configuration of a bandgap voltage reference circuit according to a second embodiment.

FIG. 13 illustrates a configuration of a bandgap voltage reference circuit according to a second embodiment. The bandgap voltage reference circuit includes a buffer circuit B1 which is driven by a differential output signal 24 output from an operational amplifier A1 and outputs an output current Iout. The circuit further includes a current control circuit C1 which, when an output voltage Vout is lower than a threshold voltage Vth, disables a control signal 16 to disable the function of decreasing output current of the output current supply circuit of the buffer B1. When the function of decreasing the output current of the output current supply circuit of the buffer circuit B1 is disabled, all current from the current source in the buffer circuit B1 is provided to an output terminal Out as an output current Iout. When the output voltage Vout becomes equal to or greater than the threshold voltage Vth, the current control circuit C1 enables the control signal 16 to place the buffer circuit B1 in a normal operation state. In this state, the operational amplifier A1 and the buffer circuit B1 increase or decrease the output current Iout according to the difference voltage between the inputs.

In the bandgap voltage reference circuit according to the second embodiment, the buffer circuit B1 is provided in order to increase the load driving capability of the operational amplifier A1 and the output 24 from the operational amplifier A1 is used to drive the buffer circuit B1 to change the amount of the output current. In this configuration, during power-up, the current control circuit C1 disables the function of decreasing output current of the output current supply circuit of the buffer circuit B1 to provide the output current Iout to the output terminal Out regardless of the difference between the inputs.

Figure 14:
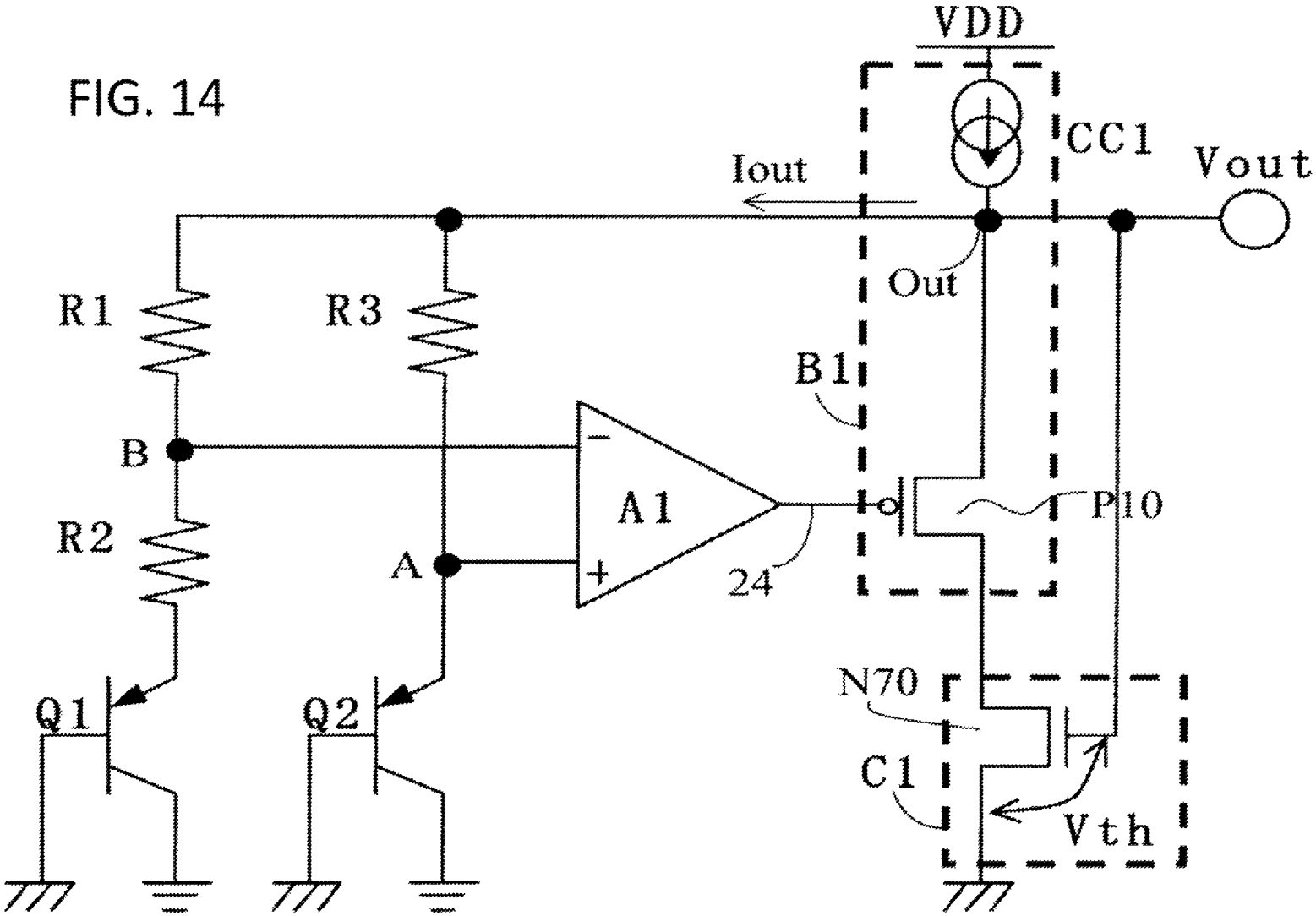
FIG. 14 is a circuit diagram of a first example of the bandgap voltage reference circuit according to the second embodiment.

FIG. 14 is a circuit diagram of a first example of the bandgap voltage reference circuit of the second embodiment. In the first exemplary circuit, a P-channel transistor P10 and a current source CC1 are provided as a buffer circuit B1 and an N-channel transistor N70 having a gate coupled to the output terminal Out is provided as an output current control circuit C1. The transistor P10 and the transistor N70 are provided between the output terminal Out and a ground Vss.

In the first exemplary circuit, the operational amplifier A1 may be considered as a differential circuit that generates a differential output signal 24 according to the difference between input voltages and the buffer circuit B1 may be considered as an output current supply circuit that outputs an output current Iout according to the differential output signal 24.

During a power-up period in which Vout is lower than Vth, the transistor N70 is turned off and the transistor P10 of the buffer circuit B1 is disabled to allow all current from the current source CC1 is to be output as the output current Iout. That is, the amount of the output current Iout is increased. When Vout becomes greater than or equal to Vth, normal operation is started. For example, the transistor N70 is turned on, the transistor P10 of the buffer circuit B1 is driven according to the differential output signal 24 from the operational amplifier A1, and the buffer circuit B1 increases or decreases the output current Iout being output to the output terminal Out.

In the normal operation, when VB<VA, the differential output signal 24 rises, the degree of conduction of the transistor P10 decreases (the conduction resistance increases), and the output current Iout increases. On the other hand, when VB>VA, the differential output signal 24 drops, the degree of conduction of the transistor 10 increases (the conduction resistance decreases), and the output current Iout decreases.

Figure 15:
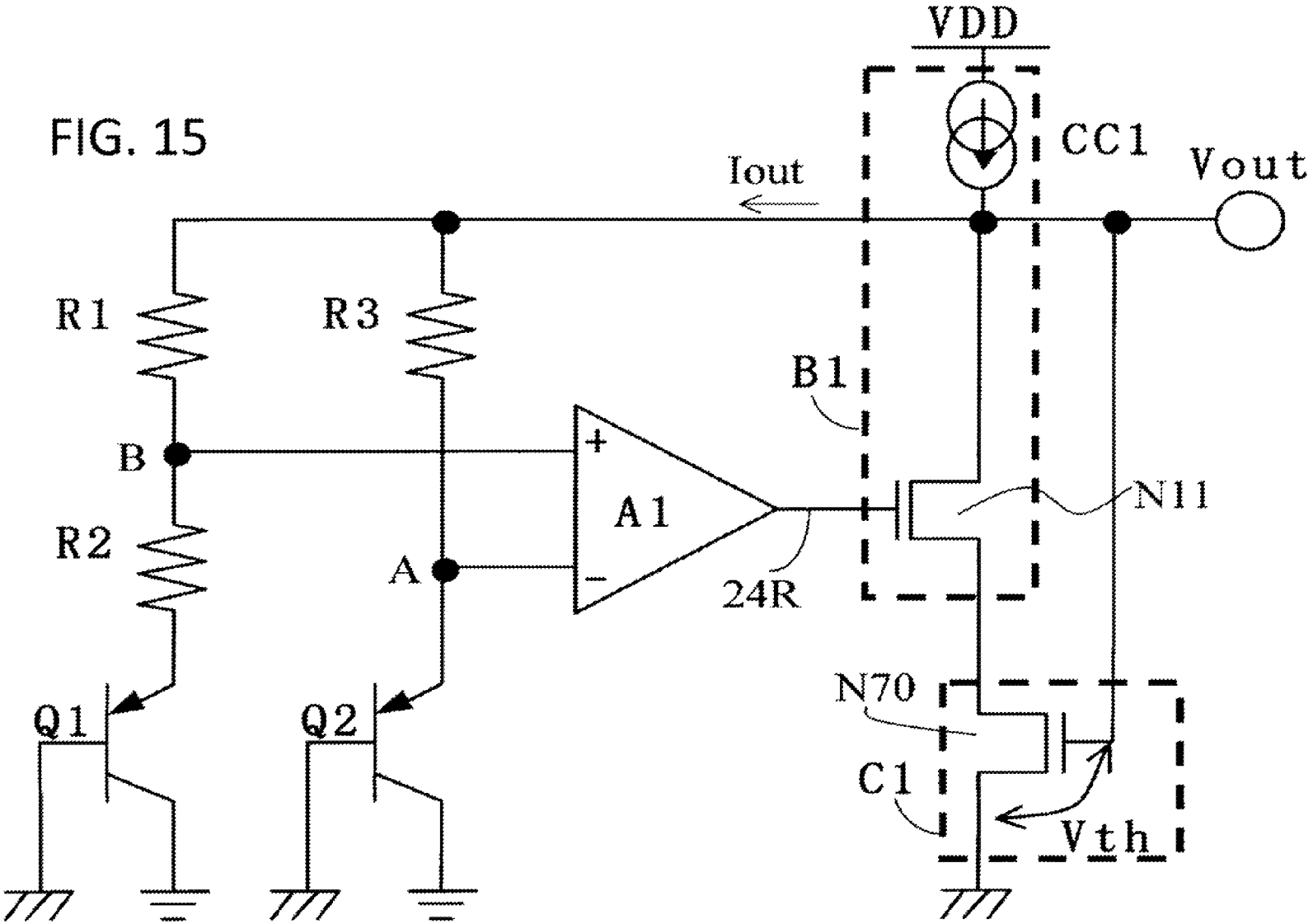
FIG. 15 is a circuit diagram of a second example of the bandgap voltage reference circuit according to the second embodiment.

FIG. 15 is a circuit diagram of a second example of the bandgap voltage reference circuit according to the second embodiment. In the second exemplary circuit, an N-channel transistor N11 and a current source CC1 are provided as a buffer circuit B1 and an N-channel transistor N70 having a gate coupled to the output terminal Out is provided as an output current control circuit C1. The transistor N11 and the transistor N70 are provided between the output terminal Out and a ground Vss.

In the second exemplary circuit, the operational amplifier A1 may be considered as a differential circuit which generates a differential output signal 24R according to the difference between input voltages and the buffer circuit B1 may be considered as an output current supply circuit which outputs an output current Iout according to the differential output signal 24R.

During the power-up period in which Vout is lower than Vth, the transistor N70 is turned off and the transistor N11 of the buffer circuit B1 is disabled to allow all current from the current source CC1 is to be output as the output current Iout. When Vout becomes greater than or equal to Vth, normal operation is started. For example, the transistor N70 is turned on, the transistor N11 of the buffer circuit B1 is driven according to the differential output signal 24R from the operational amplifier A1, and the buffer circuit B1 increases or decreases the output current Iout being output to the output terminal Out.

The coupling of the input terminals of the operational amplifier A1 to nodes A and B is the reverse of that in the first exemplary circuit in FIG. 14. Accordingly, when VB<VA in normal operation, the differential output signal 24R drops, the degree of conduction of the transistor N11 decreases, and the output current Iout increases. On the other hand, when VB>VA, the differential output signal 24R rises, the degree of conduction of the transistor N11 increases, and the output current Iout decreases.

The first and second exemplary circuits in FIGS. 14 and 15 are shunt reference circuits with buffer. On the other hand, third and fourth exemplary circuits in FIGS. 16 and 17 are series reference circuits with buffer.

Figure 16:
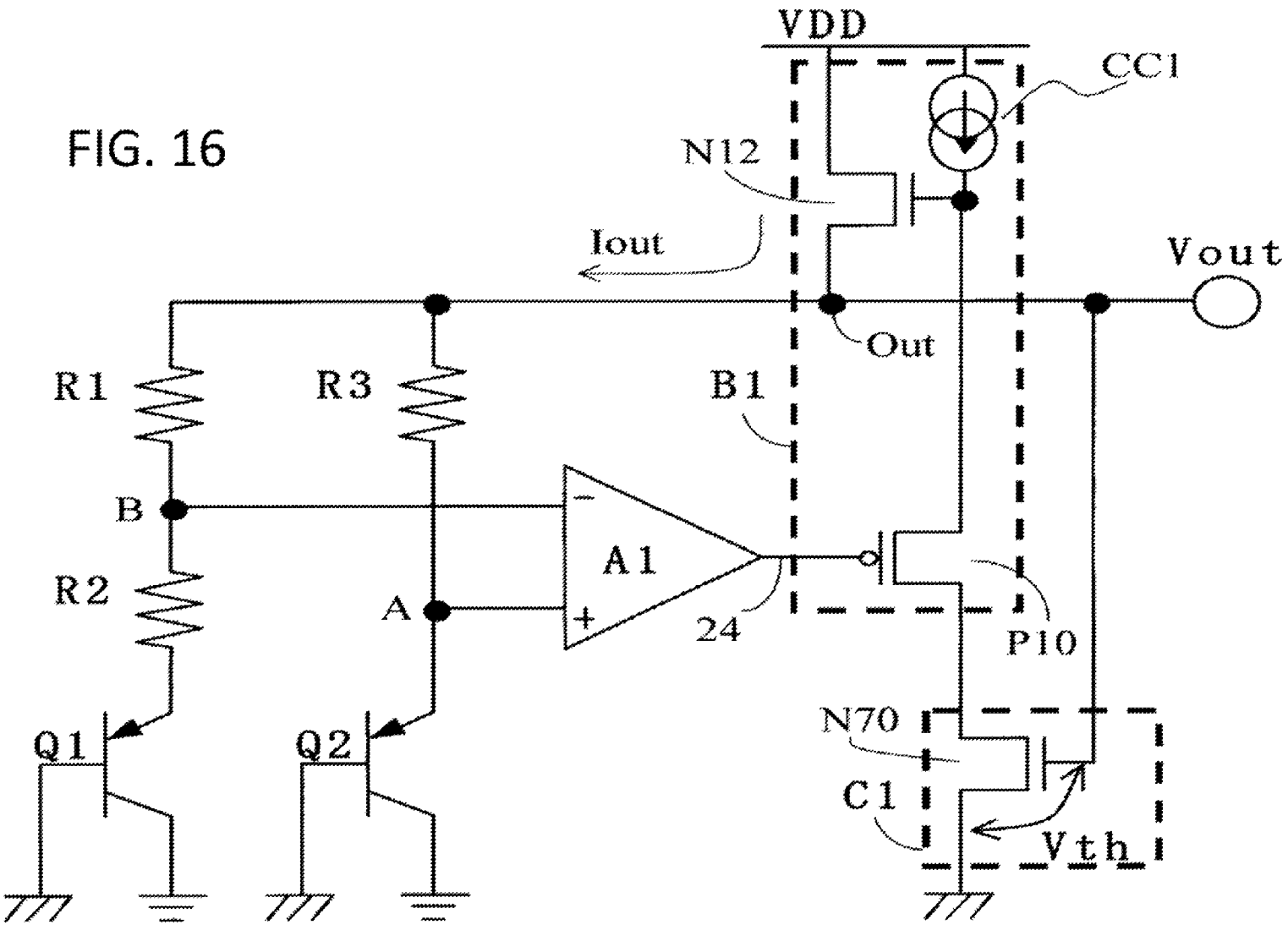
FIG. 16 is a circuit diagram of a third example of the bandgap voltage reference circuit according to the second embodiment.
Figure 17:
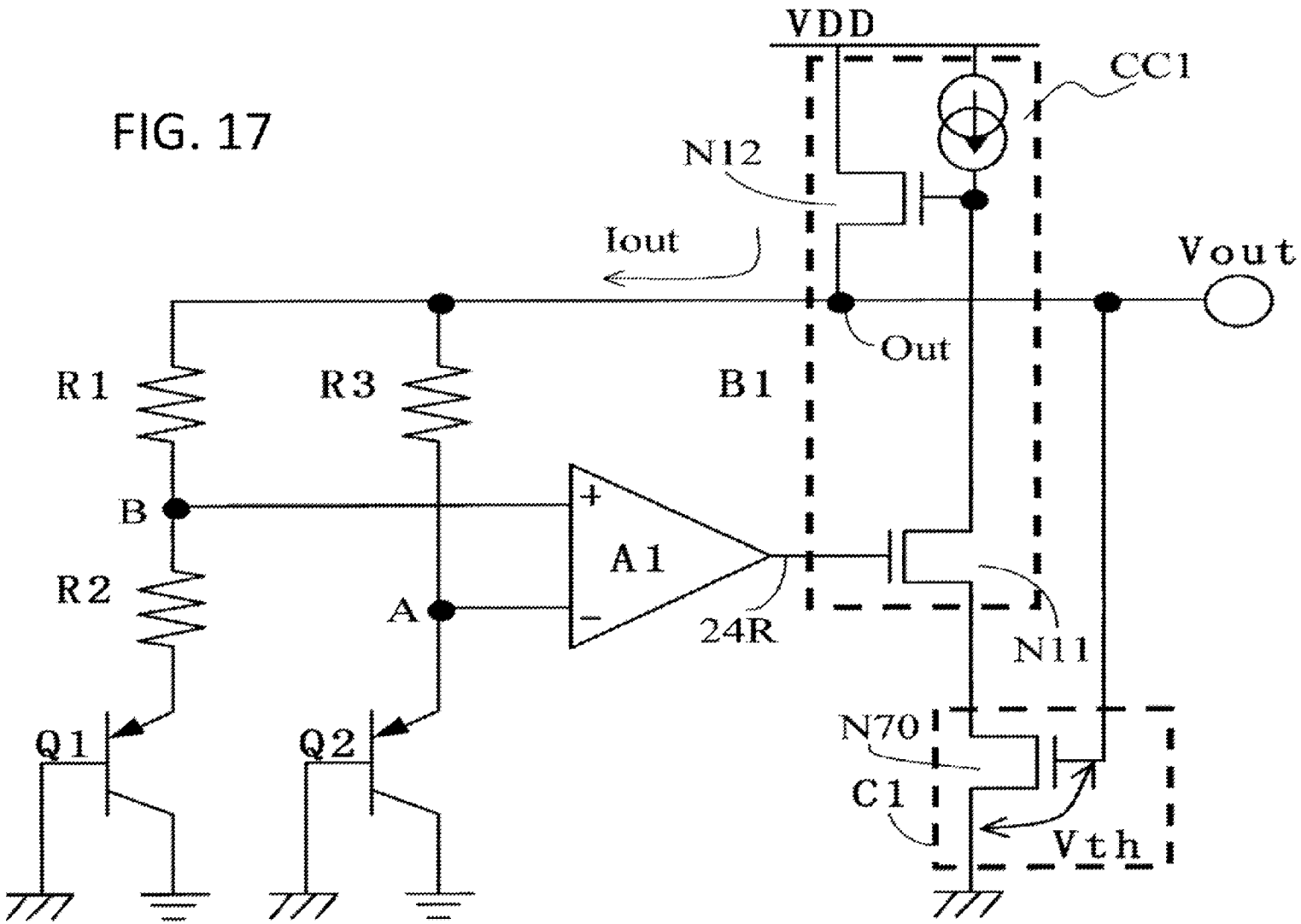
FIG. 17 is a circuit diagram of a fourth example of the bandgap voltage reference circuit according to the second embodiment.

FIG. 16 is a circuit diagram of a third example of the bandgap voltage reference circuit according to the second embodiment. In the third exemplary circuit, the buffer circuit B1 includes a P-channel transistor P10, a current source CC1 and an N-channel output transistor N12, and the output current control circuit C1 includes an N-channel transistor N70 whose gate is coupled to the output terminal Out.

In the circuit, during the power-up period in which Vout is lower than Vth, the transistor N70 is turned off and the transistor P10 of the buffer circuit B1 is disabled, the degree of conduction of the output transistor N12 increases, and the output current Iout is output with the increased driving capability. When Vout becomes greater than or equal to Vth, normal operation is started. For example, the transistor N70 is turned on, the transistor P10 of the buffer circuit B1 is driven according to the differential output signal 24 from the operational amplifier A1, the driving capability of the output transistor N12 is increased or decreased, and the output current Iout output to the output terminal Out increases or decreases.

In the normal operation, when VB equals to or is smaller than VA, the differential output signal 24 rises, the degree of conduction of the transistor P10 decreases, the driving capability of the output transistor N12 increases, and the output current Iout increases. On the other hand, when VB is greater than VA, the differential output signal 24 drops, the degree of conduction of the transistor P10 increases, the driving capability of the output transistor N12 decreases, and the output current Iout decreases.

FIG. 17 is a circuit diagram of a fourth example of the bandgap voltage reference circuit according to the second embodiment. In the fourth exemplary circuit, the buffer circuit B1 includes an N-channel transistor N11, a current source CC1, and an N-channel output transistor N12 and the output current control circuit C1 includes an N-channel transistor N70 whose gate is coupled to the output terminal Out. Since the transistor N11 is an N-channel transistor, the coupling at the input terminal pair of the operational amplifier A1 is the reverse of that in FIG. 16. In normal operation, when VB>VA, the differential output signal 24R rises, the degree of conduction of the transistor N11 increases, the diving capability of the output transistor N12 decreases, and the output current Iout decreases. On the other hand, when VB<VA, the differential output signal 24R drops, the degree of conduction of the transistor N11 decreases, the driving capability of the output transistor N12 increases, and the output current Iout increases.

Figure 18:
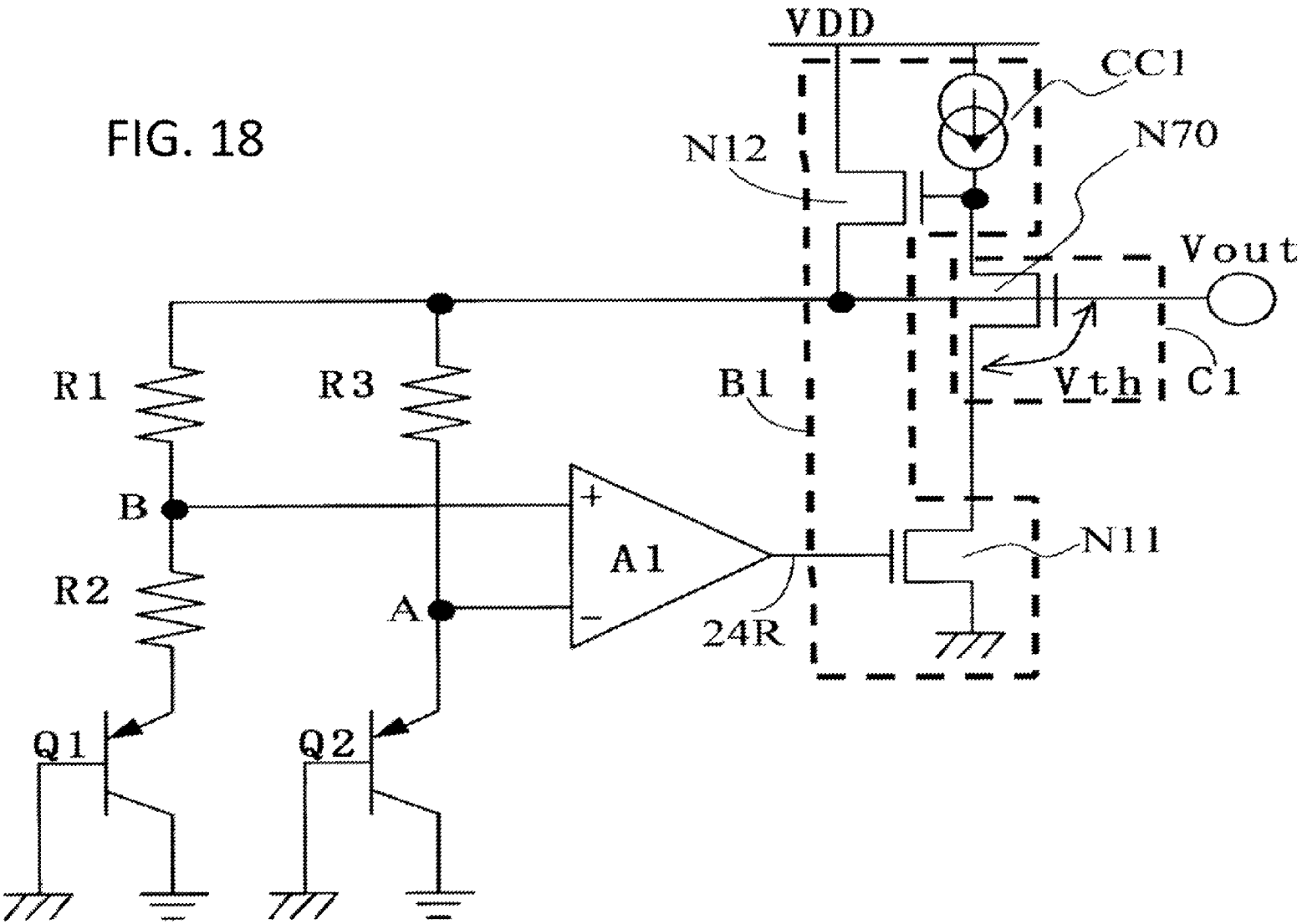
FIG. 18 is a circuit diagram illustrating a variation of the fourth example of the bandgap voltage reference circuit according to the second embodiment.

FIG. 18 is a circuit diagram of a variation of the fourth example of the bandgap voltage reference circuit according to the second embodiment. The configuration of the circuit differs from the example in FIG. 17 in that the transistor N70 of the output current control circuit C1 is provided between the transistor N11 of the buffer circuit B1 and the current source CC1. The rest of the configuration and operation is the same as the circuit in the example in FIG. 17.

In any of the first, second and third exemplary circuits in FIGS. 14, 15 and 16, the transistor N70 of the output current control circuit C1 may be provided between the transistor N11 or P10 of the buffer circuit B1 and the current source CC1 as in the exemplary circuit in FIG. 18.

Figure 19:
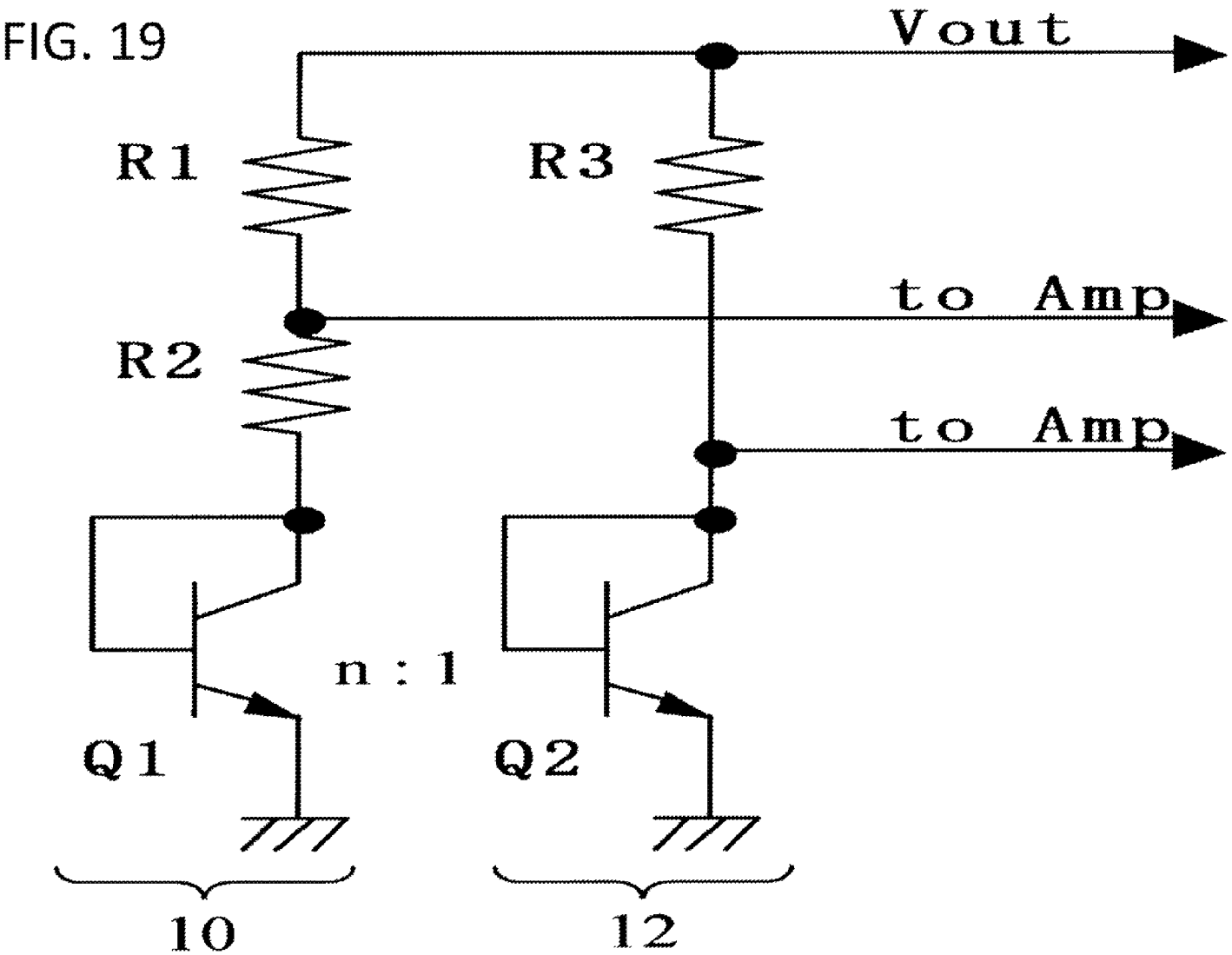
FIG. 19 is a diagram illustrating a variation of P-N junction elements of a bandgap voltage reference circuit according to the present embodiment.

FIG. 19 is a diagram illustrating a variation of the P-N junction elements of the bandgap voltage reference circuit according to the present embodiments. first and second P-N junction circuits 10 and 12 are depicted in FIG. 19 and the other components are omitted from FIG. 19. In the examples described above, the P-N junction elements are PNP transistors whose base and collector are coupled to the ground Vss. In the example in FIG. 19, the P-N junction elements are emitter-grounded NPN transistors Q1 and Q2 whose base and collector are shorted. The emitter area ratio of the two transistors is n:1 as in the examples described above.

As has been descried, the bandgap voltage reference circuit of any of the present embodiments uses the operational amplifier A1's function of providing an output current Iout is used to cause the output current Iout to be output to the output terminal at a high performance level regardless of the difference between input voltages, thereby increasing the output voltage Vout to a value near the second stable point during power-up. Therefore, a startup circuit does not need to be provided and accordingly current consumption may be minimized.

All examples and conditional language recited herein are intended for pedagogical purposes to aid the reader in understanding the invention and the concepts contributed by the inventor to furthering the art, and are to be construed as being without limitation to such For example recited examples and conditions, nor does the organization of such examples in the specification relate to a depicting of the superiority and inferiority of the invention. Although the embodiments of the present invention have been described in detail, it should be understood that the various changes, substitutions, and alterations could be made hereto without departing from the spirit and scope of the invention.

What is claimed is:

1. A bandgap voltage reference circuit comprising:

a first circuit generating a first voltage which changes according to a first characteristic;

a second circuit generating a second voltage which changes according to a second characteristic different from the first characteristic;

an amplifier receiving the first and second voltages, and changing and supplying an amount of an output current from a first power supply to an output terminal according to a difference voltage between the first and second voltages, wherein an output voltage at the output terminal is provided to the first and second circuits; and an output current controller providing a control signal to the amplifier to cause the amplifier to supply the output current from the first power supply to the output terminal regardless of the difference voltage when the output voltage equals or is smaller than a threshold voltage, wherein the output current controller connects with the output terminal and the amplifier.

2. The bandgap voltage reference circuit according to claim 1, wherein:

the first circuit comprises first and second resistances and a first P-N junction element which are provided between the output terminal and a second power supply and generates the first voltage at a first coupling point between the first and second resistances; and the second circuit comprises a third resistance and a second P-N junction element which are provided between the output terminal and the second power supply and generates the second voltage at a second coupling point between the third resistance and the second P-N junction element, wherein the second P-N junction element has a junction area smaller than that of the first P-N junction element.

3. The bandgap voltage reference circuit according to claim 1, wherein the amplifier comprises:

a differential circuit generating a differential output signal dependent on the difference voltage; and an output current supply circuit changing the amount of the output current according to the differential output signal.

4. The bandgap voltage reference circuit according to claim 3, wherein the output current controller causes the amplifier to change the amount of the output current according to the difference voltage when the output voltage is greater than the threshold voltage.

5. The bandgap voltage reference circuit according to claim 3, wherein:

the output current supply circuit comprises a current source provided between the first power supply and the output terminal and a pull-down device provided between the output terminal and the second power supply, the pull-down device having a conduction resistance which changes according to the differential output signal; and the output current controller disables the pull-down device when the output voltage equals or is smaller than the threshold voltage.

6. The bandgap voltage reference circuit according to claim 3, wherein:

the output current supply circuit comprises an output transistor provided between the first power supply and the output terminal for providing the output current to the output terminal;

the differential circuit drives the output transistor by using the differential output signal; and the output current controller controls the differential output signal to increase the driving capability of the output transistor regardless of the difference voltage when the output voltage equals or is smaller than the threshold voltage.

7. The bandgap voltage reference circuit according to claim 6, wherein:

the differential circuit comprises a current source coupled to the first power supply and a pull-down transistor coupled to the second power supply and generates the differential output signal at a coupling node between the current source and the pull-down transistor; and the output current controller comprises an output current control transistor provided between the pull-down transistor and the second power supply or between the pull-down transistor and the coupling node and having a gate coupled to the output terminal.

8. The bandgap voltage reference circuit according to claim 3, wherein:

the output current supply circuit comprises an output transistor provided between the first power supply and the output terminal and a pull-down transistor provided between the second power supply and a gate of the output transistor, the gate of the output transistor being driven by the differential output signal; and the output current controller controls the pull-down transistor to control the differential output signal to increase a current output from the output transistor when the output voltage equals or is smaller than the threshold voltage.

9. The bandgap voltage reference circuit according to claim 1, wherein:

the amplifier comprises an amplification section generating a differential output signal dependent on the difference voltage and a buffer circuit changing the amount of the output current according to the differential output signal;

the buffer circuit comprises a current source provided between the first power supply and the output terminal and a pull-down transistor provided between the output terminal and the second power supply, the pull-down transistor being controlled by the differential output signal; and the output current controller comprises an output current control transistor provided between the pull-down transistor and the second power supply or between the pull-down transistor and a current source and having a gate coupled to the output terminal.

10. The bandgap voltage reference circuit according to claim 1, wherein:

the amplifier comprises an amplification section generating a differential output signal dependent on the difference voltage and a buffer circuit changing the amount of the output current according to the differential output signal;

the buffer circuit comprises a current source coupled to the first power supply, a pull-down transistor provided between the current source and a second power supply and controlled by the differential output signal, and an output transistor provided between the current source and an output terminal, the output transistor having a gate coupled to a coupling node between the current source and the pull-down transistor and providing the output current to an output terminal; and the output current controller comprises an output current control transistor provided between the pull-down transistor and the second power supply or between the pull-down transistor and the current source, the output current control transistor having a gate coupled to the output terminal.

11. The bandgap voltage reference circuit according to claim 2, wherein the P-N junction element is a PNP bipolar transistor having a base and a collector which are coupled to the second power supply.

12. The bandgap voltage reference circuit according to claim 2, wherein the P-N junction element is an NPN bipolar transistor having an emitter coupled to the second power supply and a base and a collector coupled with each other.

13. The bandgap voltage reference circuit according to claim 1, wherein:

the operational amplifier becomes stable when the output voltage is at a first stable point and at a second stable point higher than the first stable point; and the threshold voltage is higher than an output voltage at the first stable point.

14. A bandgap voltage reference circuit comprising:

a first circuit generating a first voltage which changes according to a first characteristic;

a second circuit generating a second voltage which changes according to a second characteristic different from the first characteristic;

an amplifier receiving the first and second voltages, and changing and supplying an amount of an output current from a power supply to an output terminal, according to a difference voltage between the first and second voltages, when an output voltage at the output terminal is greater than a threshold voltage, wherein the output voltage is provided to the first and second circuits; and an output current controller being in an off gate when the output voltage equals or is smaller than the threshold voltage, and, when in the off state, causing a transistor within the amplifier to increase the output current and to supply the increased output current from the power supply to the output terminal regardless of the difference voltage, wherein the output current controller connects with the output terminal and the amplifier.

* * * * *

UNITED STATES PATENT AND TRADEMARK OFFICE

CERTIFICATE OF CORRECTION

PATENT NO. : 8,933,682 B2
APPLICATION NO. : 12/853425
DATED : January 13, 2015
INVENTOR(S) : Yoshiomi Shiina It is certified that error appears in the above-identified patent and that said Letters Patent is hereby corrected as shown below:

In the Claims:

Claim 14, column 15, line 1, "off gate" should read --off state--.

Signed and Sealed this
Ninth Day of June, 2015

Michelle K. Lee

Michelle K. Lee
*Director of the United States Patent and Trademark Office*